US012595957B2

(12) United States Patent
Son

(10) Patent No.: US 12,595,957 B2
(45) Date of Patent: Apr. 7, 2026

(54) REFRIGERATOR

(71) Applicant: LG Electronics Inc., Seoul (KR)

(72) Inventor: Younghun Son, Seoul (KR)

(73) Assignee: LG Electronics Inc., Seoul (KR)

( * ) Notice: Subject to any disclaimer, the term of this patent is extended or adjusted under 35 U.S.C. 154(b) by 103 days.

(21) Appl. No.: 18/392,154

(22) Filed: Dec. 21, 2023

(65) Prior Publication Data

US 2024/0240848 A1 Jul. 18, 2024

(30) Foreign Application Priority Data

Jan. 13, 2023 (KR) ..... 10-2023-0005424

(51) Int. Cl.
*F25D 23/00* (2006.01)
*F25D 23/06* (2006.01)
*F25D 27/00* (2006.01)

(52) U.S. Cl.
CPC ..... *F25D 23/063* (2013.01); *F25D 27/00* (2013.01); *F25D 2201/12* (2013.01)

(58) Field of Classification Search
CPC .... F25D 23/063; F25D 27/00; F25D 2201/12; F25D 2323/02
USPC ..... 312/405
See application file for complete search history.

(56) References Cited

U.S. PATENT DOCUMENTS 9,829,241 B2 * 11/2017 Seo ..... A47F 3/043
2017/0191746 A1 * 7/2017 Seo ..... F25D 27/005
2019/0271500 A1 * 9/2019 Lee ..... G02B 6/009
2019/0360745 A1 11/2019 Lee et al.
2020/0326120 A1 * 10/2020 Kim ..... F25D 23/028
2022/0003494 A1 * 1/2022 Kwon ..... F25D 29/005

FOREIGN PATENT DOCUMENTS

EP 3333515 B1 11/2019
EP 3378360 B1 7/2022
KR 10-2018-0074514 A 7/2018
KR 10-1892854 B1 8/2018

OTHER PUBLICATIONS

Extended European Search Report in European Appln. No. 24150916.5, mailed on May 29, 2024, 8 pages.

* cited by examiner

*Primary Examiner* — James O Hansen
(74) *Attorney, Agent, or Firm* — Fish & Richardson P.C.

(57) ABSTRACT

A refrigerator includes a cabinet having a storage space, and a door configured to open and close the storage space. The door includes a panel assembly including a front panel that defines a front surface of the door and is made of a transparent material, and a rear panel disposed behind the front panel and made of a transparent material, a door liner that defines a rear surface of the door and a liner opening shielded by the rear panel, an insulating material filled into a space between a perimeter of the panel assembly and the door liner, a lighting device configured to illuminate a space behind the door, and a light case coupled to the door liner. The light case connects the rear panel to the door liner, blocks an inflow of the insulating material, and defines a recess space accommodating the lighting device.

20 Claims, 17 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2023-0005424, filed on Jan. 13, 2023, which is hereby incorporated by reference in its entirety.

BACKGROUND

The present disclosure relates to a refrigerator.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Such refrigerators tend to increase more and more in size and provide multi-functions due to the trends of change of dietary life and high quality, and accordingly, refrigerators provided with various structures and convenience devices in consideration of user convenience are brought to the market.

A refrigerator, in which a portion of a refrigerator door has a structure that is capable of being seen therethrough, a light inside the refrigerator is turned on/or to selectively see the inside of the refrigerator from the outside of the refrigerator door, is being developed.

SUMMARY

Embodiments provide a refrigerator having a structure in which a lighting device is easily mounted so that the inside of the refrigerator is capable of being seen.

Embodiments also provide a refrigerator, in which an outer appearance of a door is improved, and insulation performance of the door is secured.

Embodiments also provide a refrigerator having a structure of a lighting device for illuminating a long viewing window.

In one embodiment, a refrigerator includes: a cabinet having a storage space; and a door configured to open and close the storage space, wherein the door includes: a panel assembly comprising a front panel configured to define a front surface of the door and made of a transparent material, and a rear panel disposed behind the front panel and made of a transparent material; a door liner configured to a rear surface of the door and having a liner opening shielded by the rear panel; an insulating material filled into a space between a perimeter of the panel assembly and the door liner; a lighting device configured to illuminate a space behind the door; and a light case which is coupled to the door liner and in which the lighting device is mounted, wherein the light case is configured to connect the rear panel to the door liner so as to block an inflow of the insulating material and define a recess space in which the lighting device is accommodated.

A protrusion that protrudes backward rather than the rear panel and is filled with the insulating material may be disposed on the door liner, and the light case may be provided inside the protrusion.

A transparent see-through portion through which a rear space of the door is seen, and an opaque bezel portion around the see-through portion may be disposed on the front panel, and the light case may be disposed on the bezel portion.

The protrusion may be disposed at each of both sides of the see-through portion, and the lighting device may be configured to emit light in direction facing each other.

The protrusion may be disposed along at least one side of the see-through portion.

The protrusion may be provided in a pair, which are spaced apart from each other to extend vertically, and a basket mounting portion to which a door basket is coupled and a light opening in which the light case is mounted may be provided on/in facing inner surfaces of the protrusion.

The light opening may be defined by cutting an end of the door liner, be in contact with a rear panel of the rear panel, and extend vertically along the protrusion.

The lighting device may be provided between the basket mounting portion and the rear panel.

The door basket may be provided vertically in plurality, and the lighting device may extend to pass through the plurality of door basket.

The light case may include: an accommodation portion opened to be exposed through the door liner and recessed so that the lighting device is accommodated; a first supporter provided in plurality along the accommodation portion and protruding to support an inner surface of the protrusion; and a second supporter extending along the accommodation portion and protruding in a direction opposite to the first support, and in contact with the panel assembly.

A connecting portion that is more recessed so that an electric wire connected to the lighting device and a connector are disposed may be disposed on the accommodation portion, and the lighting device may be connected to the connector inside the accommodation portion.

The first supporter may include: a contact portion that is in contact with the inner surface of the protrusion to extend up to an end of the protrusion; and a partition portion extending from the accommodation portion and the contact portion to partition the inside of the protrusion.

A partition portion groove through which the insulating material filled into the protrusion passes may be defined in the partition portion, and the partition portion may be provided in plurality along the first supporter.

A rear surface of the panel assembly may be supported by a front surface of the accommodation portion, and a perimeter of the panel assembly may be supported by the second supporter.

The lighting device may include: a substrate on which a plurality of LEDs are disposed; a light frame on which the substrate is mounted; and a light cover which is configured to shield an opened one surface of the light frame and through which light of the LEDs is transmitted, wherein the light cover may be configured to shield an opening of the light case.

The LEDs may include RGB LEDs and are configured to adjust a color of emitted light according to user's selection.

The light frame may include: a first reflective surface and a second reflective surface, which are spaced apart from each other at positions facing each other; and a substrate support configured to connect the first reflective surface to the second reflective surface and support the substrate, wherein the opened one surface of the light frame may be shielded by the light cover, and the other surface, which is opened, of the light frame may be shielded by the substrate.

The first reflective surface may be disposed at a position that is close to the panel assembly, and the second reflective surface is disposed at a position that is farther from the panel assembly, and an inclination of the second reflective surface may be greater than that of the first reflective surface.

The substrate may be provided in plurality, which are connected in series, a main signal line may be connected to one of the plurality of substrates, and a sub signal line configured to connect the substrates to each other may be connected between the plurality of substrates.

The lighting device may be detachably mounted on the light case through the opening of the door liner, and a substrate connector may be provided on a rear surface of the substrate, and a connector connected to the substrate connector may be provided inside the light case.

The details of one or more embodiments are set forth in the accompanying drawings and the description below. Other features will be apparent from the description and drawings, and from the claims.

BRIEF DESCRIPTION OF THE DRAWINGS

FIG. 15 is a front view illustrating the refrigerator in a state in which the lighting device is turned on.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction facing a front surface of the door illustrated in FIG. 1 may be defined as a front direction, a direction facing a cabinet with respect to the front surface of the door will be defined as a rear direction, a direction facing a bottom surface on which the refrigerator is installed will be defined as a downward direction, and a direction that is away from the bottom surface will be defined as an upward direction.

Figure 1:
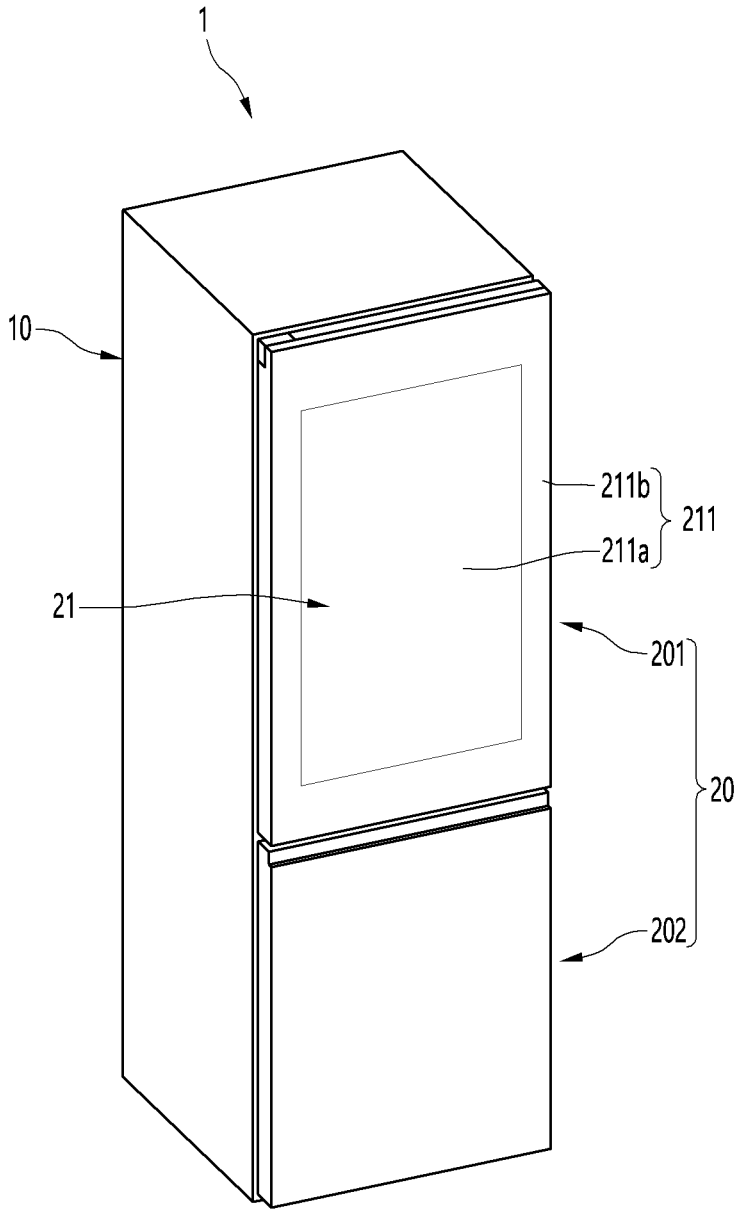
FIG. 1 is a perspective view of a refrigerator according to an embodiment.
Figure 2:
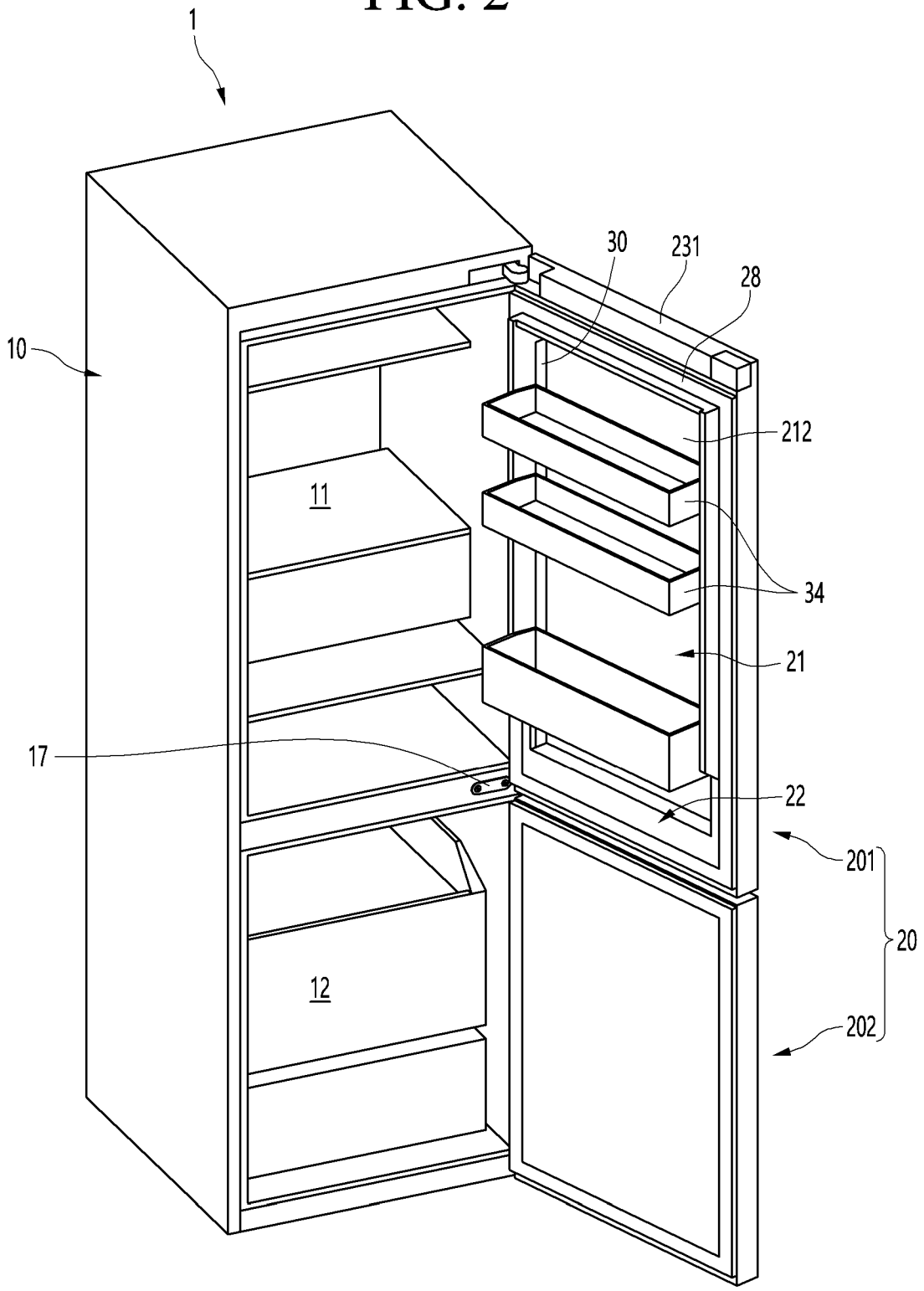
FIG. 2 is a view illustrating a state in which a door is opened.

FIG. 1 is a perspective view of a refrigerator according to an embodiment. Also, FIG. 2 is a view showing a state in which a door is opened.

As illustrated in the drawing, a refrigerator 1 according to an embodiment may include a cabinet 10 in which a storage space is defined, and a door 20 that opens and closes the storage space.

The storage space of the cabinet 10 may be divided vertically. The storage space may be constituted by a first storage compartment 11 and a second storage compartment 12 disposed below the first storage compartment 11. For example, the first storage compartment 11 may be a refrigerating compartment, and the second storage compartment 12 may be a freezing compartment.

The door 20 may include a first door 201 opening or closing the first storage compartment 11 and a second door 202 opening or closing the second storage compartment 12. For example, the first door 201 may be a refrigerating compartment door, and the second door 202 may be a freezing compartment door. The first door 201 and the second door 202 may be rotation-type doors that rotate to open and close the first storage compartment 11 and the second storage compartment 12.

The first door 201 may include a panel assembly 21 through which the storage space is capable of being seen. The panel assembly 21 may be selectively seen by turning on and off a lighting device 30, which will be described below.

The panel assembly 21 may include a front panel 211 defining a front surface of the first door 201 and a rear panel 212 disposed behind the front panel 211.

The front panel 211 may define the entire front surface of the first door 201. The front panel 211 may have an opaque bezel portion 211*b* disposed therearound. In addition, a see-through portion 211*a* may be provided inside the bezel portion 211*b*. The see-through portion 211*a* may be selectively transparent so that food stored in the storage space or the door basket 24 is identified.

Hereinafter, a structure of the first door 201 will now be described in more detail with reference to the accompanying drawings.

Hereinafter, the description will be mainly described with the first door 201, but the present disclosure may not be limited to the type or position of the door and may be applied to all doors equipped with the lighting device 30. Hereinafter, the first door 201 may be referred to as the door 20.

Figure 3:
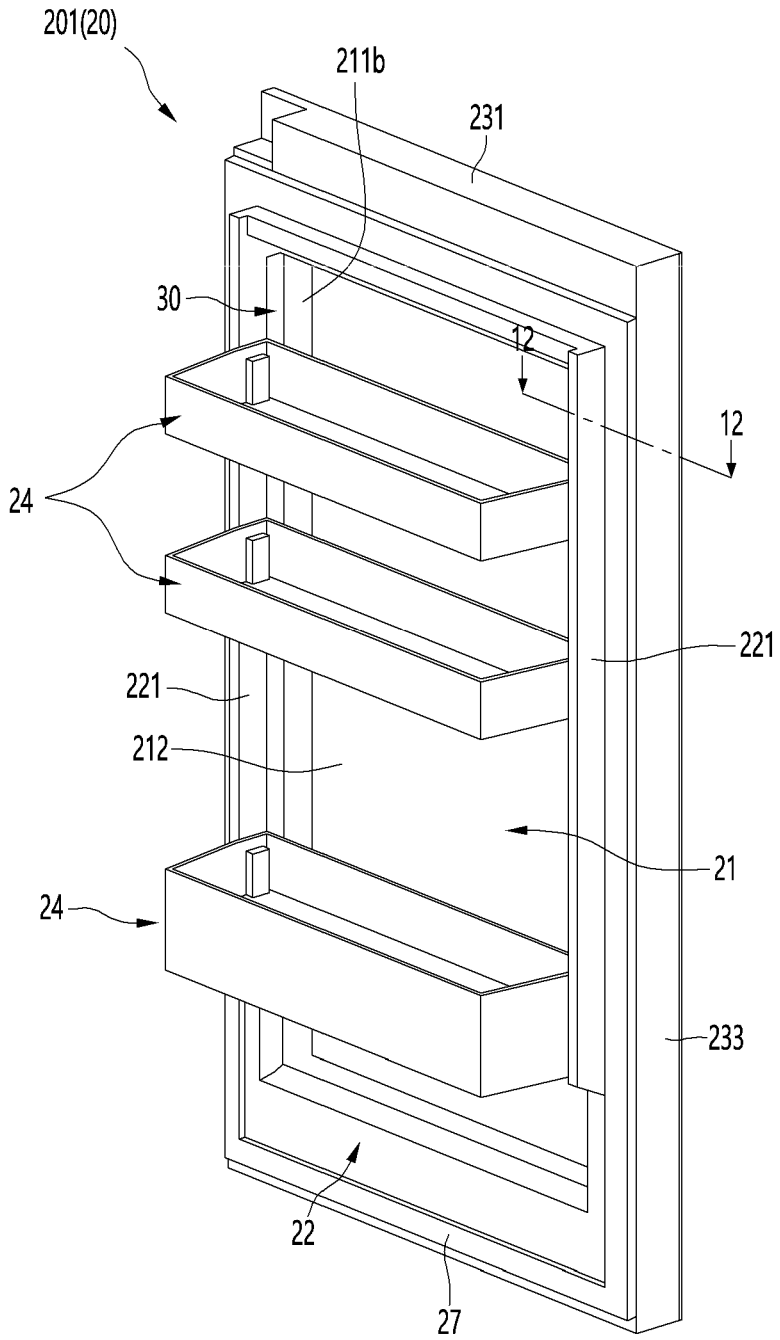
FIG. 3 is a perspective view of the door when viewed from the rear.
Figure 4:
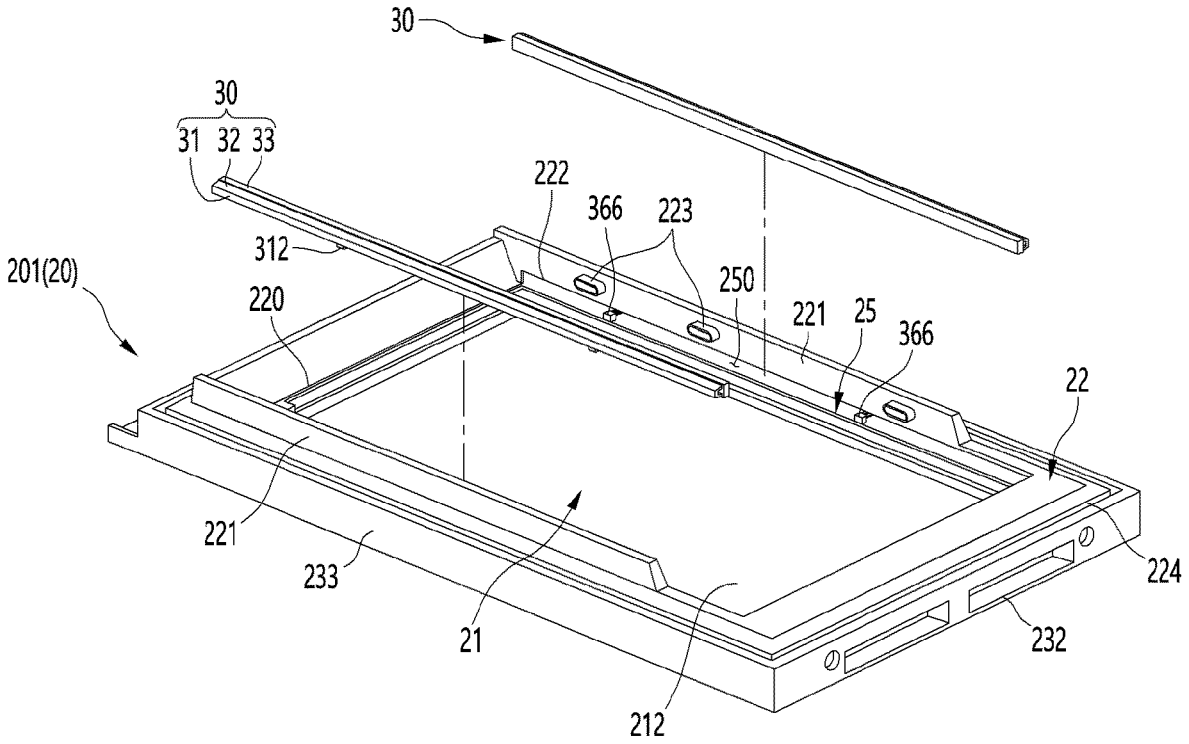
FIG. 4 is an exploded perspective view illustrating a coupling structure of the door and a lighting device.

FIG. 3 is a perspective view of the door when viewed from the rear. In addition, FIG. 4 is an exploded perspective view illustrating a coupling structure of the door and the lighting device.

As illustrated in the drawings, the door 20 may include the panel assembly 21 and the door liner 22.

The panel assembly 21 may include a front panel 211 that defines a front surface of the door 20 and a rear panel 212 that defines a portion of a rear surface of the door 20. Each of the front panel 211 and the rear panel 212 may be made of a transparent material such as glass or plastic.

The front panel 211 may define the entire front surface of the door 20 and an outer appearance of the front surface of the door 20. In addition, the rear panel 212 may shield a liner opening 220 defined in the door liner 22.

Figure 12:
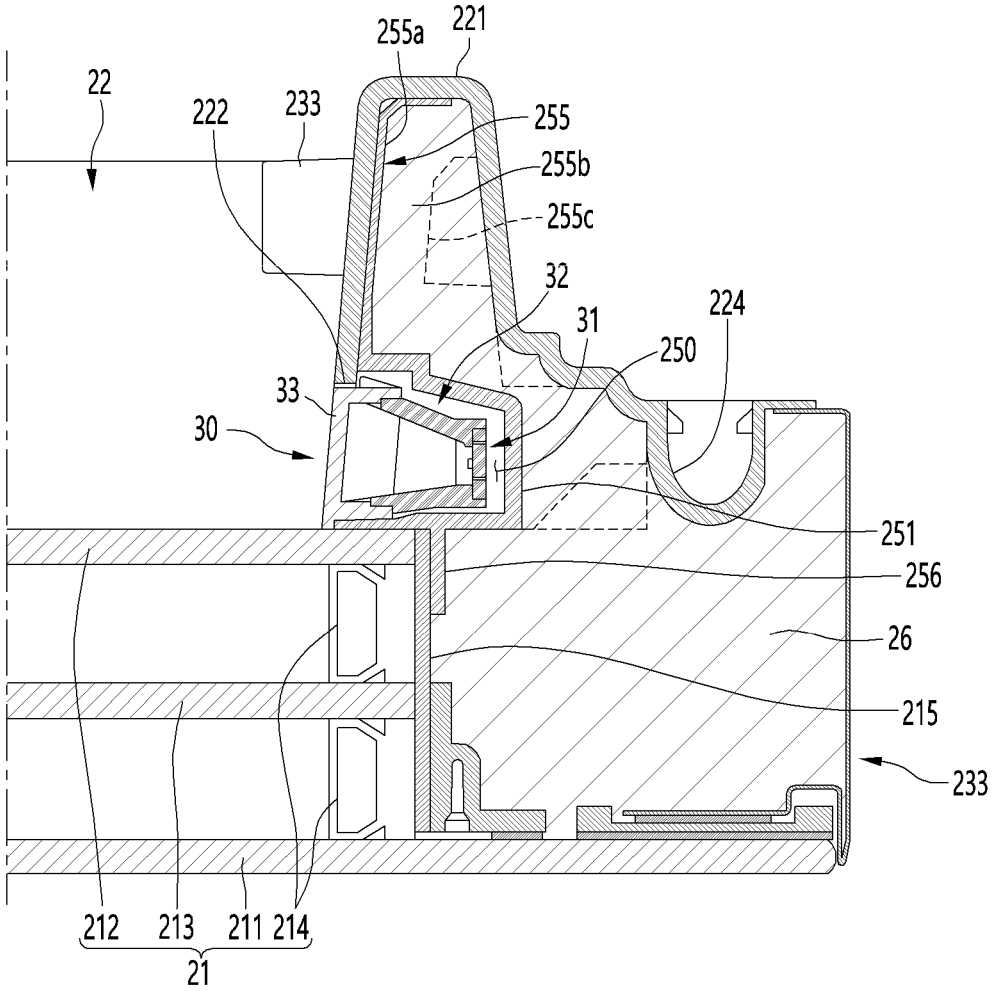
FIG. 12 is a cross-sectional view taken along line 12-12 of FIG. 3.

The panel assembly 21 may further include a spacer 214 (see FIG. 12). The spacer 214 may be provided between the front panel 211 and the rear panel 212 to connect the front panel 211 to the rear panel 212. In addition, an insulating space may be defined between the front panel 211 and the rear panel 212. In addition, an intermediate panel 213 (see FIG. 12) may be further provided between the front panel 211 and the rear panel 212, and the insulating spaces may be defined between the front panel 211 and the intermediate panel 213 and between the intermediate panel 213 and the rear panel 212 by the spacers 214, respectively.

The door liner 22 may be disposed at a rear side that is away from the front panel 211. In addition, a liner opening 220 may be defined in the door liner 22. The liner opening 220 may be defined at a position facing the see-through portion 211*a*.

In a state in which the panel assembly 21 is mounted, the front panel 211 may define the front surface of the door 20, and the rear panel 212 may shield the liner opening 220 to define a portion of the rear surface of the door 20.

A gasket groove 224 in which the gasket 27 is mounted may be defined around a rear surface of the door liner 22. In addition, a protrusion 221 protruding backward may be disposed on the rear surface of the door liner 22. The protrusion 221 may be inserted into the storage space when the door 20 is closed to prevent cold air from leaking from the storage space.

The protrusion 221 may be disposed along at least a portion of a perimeter of the liner opening 220. In addition, the protrusion 221 may be disposed outside the see-through portion 211*a*. As an example, the protrusion 221 may be disposed at each of both left and right sides of the liner opening 220. The protrusion 221 may protrude further backward than the rear panel 212. The protrusion 221 may extend to be elongated in a vertical direction. In addition, the lighting devices 30 may be mounted on the protrusions 221 at both left and right sides to face each other.

The lighting device 30 may be configured to illuminate the rear space of the door 20. When the lighting device 30 is turned on, the rear space may be visualized through the see-through portion 211*a*, and when the lighting device 30 is turned off, the see-through portion 211*a* may become opaque. In addition, the lighting device 30 may shine in various colors. Thus, the rear space of the door 20 may be visualized through the see-through portion 211*a*, and simultaneously, an outer appearance having various colors may be expressed.

A light opening 222 through which the lighting device 30 is exposed may be defined in the protrusion 221. The light opening 222 may be opened to the facing inner surfaces of the protrusions 221 disposed at both the left and right sides.

The light opening 222 may be defined by cutting one end of the door liner 22 and may be in contact with the rear surface of the rear panel 212. Thus, in the state in which the lighting device 30 is mounted on the door liner 22, the lighting device 30 may be in contact with the rear panel 212.

A plurality of basket mounting portions 223 on which the door basket 24 is mounted may be disposed on the protrusion 221. The basket mounting portion 223 may protrude from the same surface as the surface on which the liner opening 220 is defined. In addition, the basket mounting portion 223 may be provided in plurality on the protrusion 221. In addition, the plurality of the door baskets 24 may be installed behind the door 20.

Here, a front surface of the door basket 24 may be spaced apart from the rear panel 212. In addition, the lighting device 30 may extend in the vertical direction between the rear panel 212 and the door basket 24. In addition, the light opening 222 may also extend in the vertical direction along the rear panel 212 and the basket mounting portion 223.

The lighting device 30 may be provided at each of both sides of the see-through portion 211*a* and may extend in the vertical direction to pass through the plurality of door baskets 24. That is, the light opening 222 and the light case 25, which will be described below, may also extend in the vertical direction to pass through the plurality of door baskets 24.

In addition, the gasket mounting portion 224 may be disposed around the rear surface of the door liner 22. The gasket mounting portion 224 may be equipped with a gasket 27.

In addition, an upper cap decoration 231 and a lower cap decoration 232 may be provided on top and bottom surfaces of the door 20, respectively. In addition, a side frame 233 may be disposed on each of both left and right surfaces of the door 20. A space may be defined inside the door 20 in a state in which the upper decoration 231 and the lower cap decoration 232, the pair of side frames 233, and the panel assembly 21 and the door liner 22 are coupled to each other, and the insulating material 26 (see FIG. 12) may be filled into the space.

The insulating material 26 may be provided by injecting a foaming liquid. The insulating material 26 may be disposed along a perimeter of the panel assembly 21. The insulating material 26 may be filled into a space between the door liner 22 including the protrusion 221 and the panel assembly 21.

The door liner 22 may be provided with the light case 25. The light case 25 may be provided inside the door liner 22, and the lighting device 30 may be mounted inside the door liner 22.

The light case 25 may connect the door liner 22 to the panel assembly 21 to define an accommodation space 250 into which the insulating material 26 inside the door 20 does not flow. In addition, the accommodation space 250 may be exposed through the light opening 222. Thus, the lighting device 30 may be mounted on the light case 25 through the light opening 222 and may have a structure that is detachable in a state in which the door 20 is assembled. The lighting device 30 may be mounted on the light case 25 after forming the insulating material 26 by injecting the foaming liquid into the door 20.

The light case 25 may be mounted inside the protrusion 221 in the vertical direction at each of both left and right sides of the door, as illustrated in the drawings. In some examples, the protrusion 221 may protrude backward along at least one end of upper and lower ends of the liner opening 220, and the light case 25 and the lighting device 30 may also be disposed on at least a portion of the protrusions disposed at the upper and lower sides.

Hereinafter, a structure of the lighting device 30 will be described in more detail with reference to the drawings.

Figure 5:
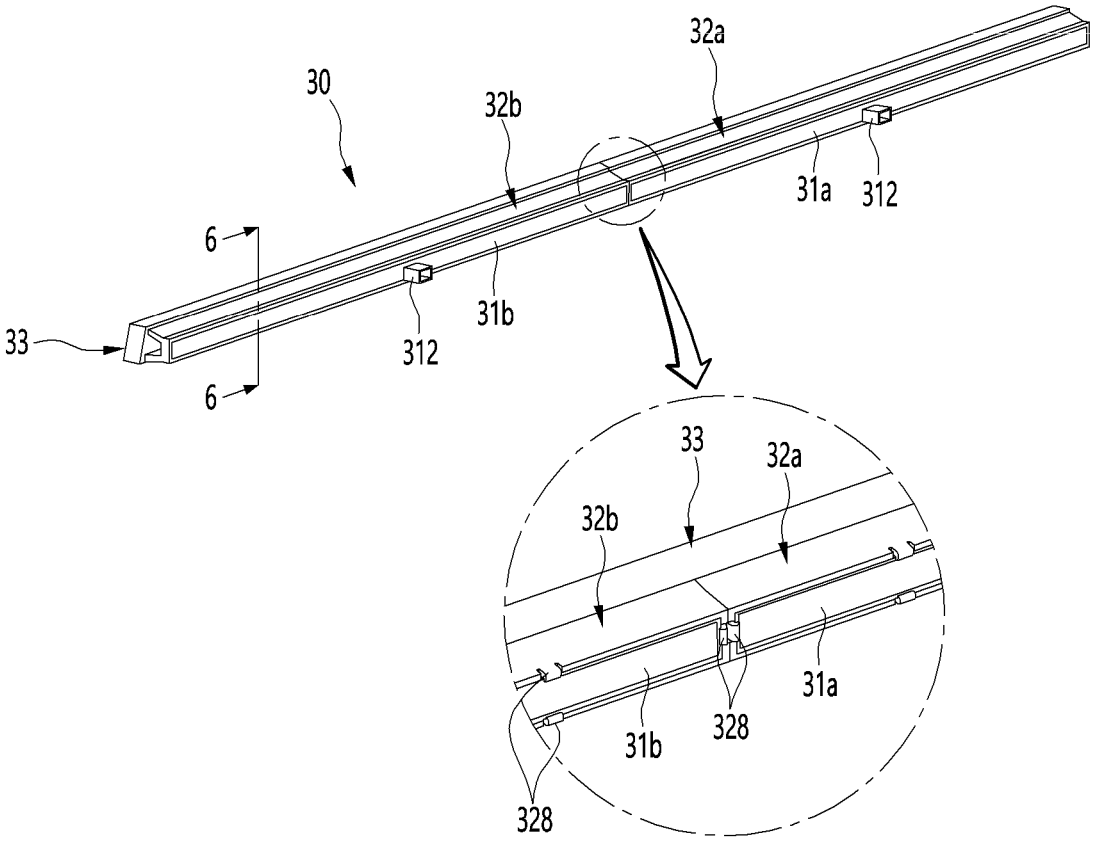
FIG. 5 is a perspective view of the lighting device.
Figure 6:
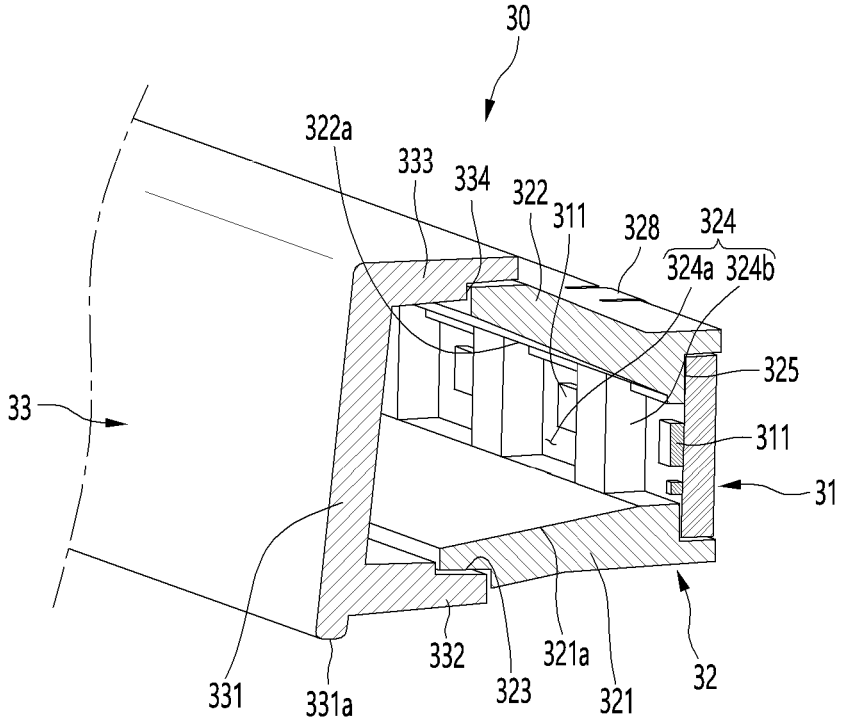
FIG. 6 is a perspective view taken along line 6-6 of FIG. 5.
Figure 7:
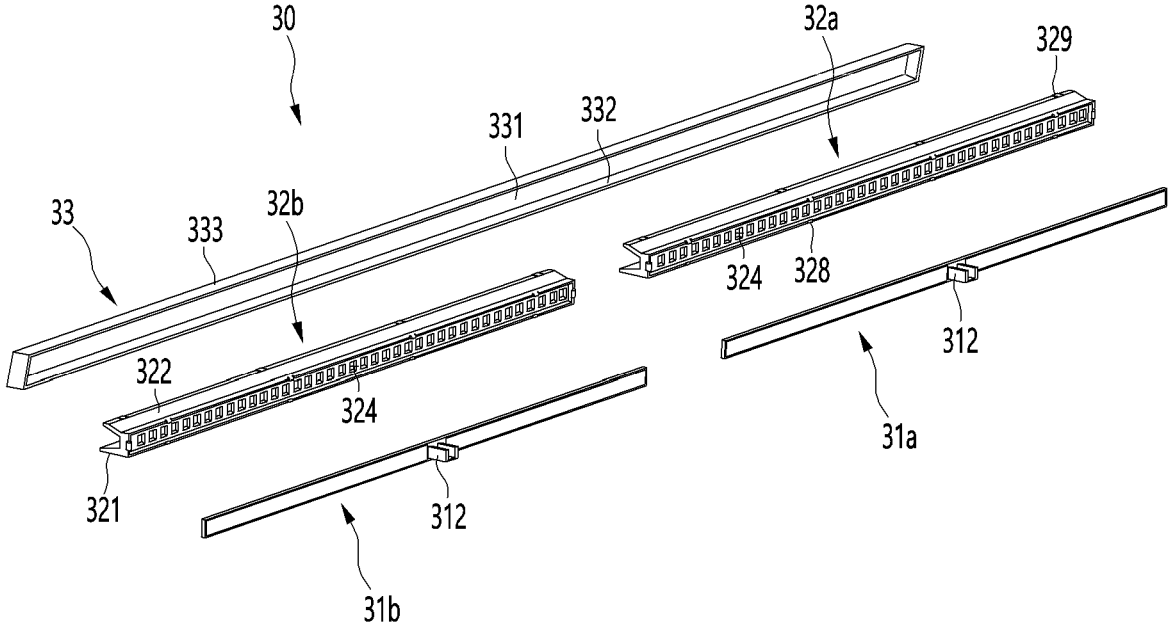
FIG. 7 is an exploded perspective view of the lighting device.
Figure 8:
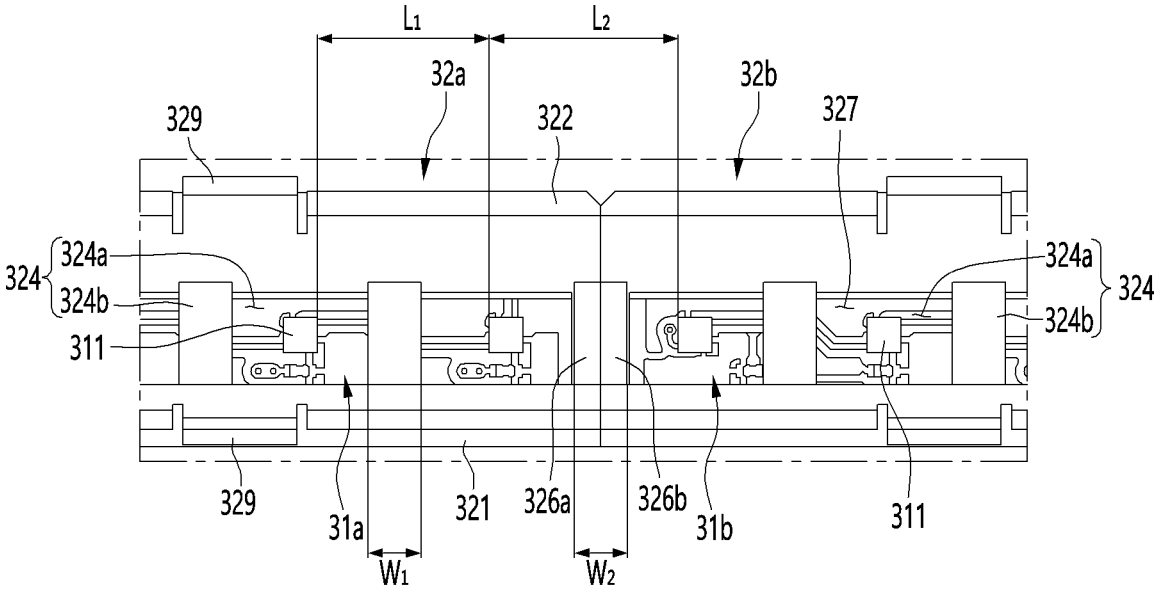
FIG. 8 is a plan view illustrating a state in which a cover of the lighting device is separated.

FIG. 5 is a perspective view of the lighting device. In addition, FIG. 6 is a perspective view taken along line 6-6 of FIG. 5. FIG. 7 is an exploded perspective view of the lighting device. FIG. 8 is a plan view illustrating a state in which a cover of the lighting device is separated.

As illustrated in the drawings, the lighting device 30 may be disposed to extend in a longitudinal direction. In addition, the lighting device 30 may be disposed to have a length corresponding to a length of the see-through portion 211*a*. In addition, the lighting device 30 may be provided to shield the accommodation space 250 and the light opening 222.

The lighting device 30 may include a substrate 31 on which an LED 311 is disposed, a light frame 32 on which the substrate 31 is mounted, and a light cover 33 through which light of the LED 311 is transmitted.

In detail, the substrate 31 may be disposed to extend in the longitudinal direction of the lighting device 30, and a plurality of LEDs 311 may be continuously arranged at a regular interval. The LED 311 may be provided as an RGB LED to shine in various colors and may also be changed to a set color.

The substrate 31 may have a length corresponding to the see-through portion 211*a*. The see-through portion 211*a* may have various sizes depending on a size of the door 20. However, when the see-through portion 211*a* has a long length in the vertical direction, the substrate 31 may be divided into a plurality of pieces to facilitate molding.

For example, the lighting device 30 may include two substrates 31 disposed at both left and right sides of the see-through portion 211*a*. The substrate 31 may be constituted by an upper substrate 31*a* and a lower substrate 31*b*, and the upper substrate 31*a* and the lower substrate 31*b* may be arranged in series. Thus, one lighting device 30 may be configured by connecting the upper substrate 31*a* and the lower substrate 31*b*, which are arranged vertically, to each other. Here, the upper substrate 31*a* and the lower substrate 31*b* may have the same structure, and in particular, a lower end of the upper substrate 31*a* and an upper end of the lower substrate 31*b* may be adjacent to each other. Here, a distance L1 between the LED 311 disposed on the lower end of the upper substrate 31*a* and the LED 311 disposed on the upper end of the lower substrate 31*b* may be arranged to be the same as a distance L1 between other LEDs 311. Therefore, even if the substrate 31 is provided in two, uniform brightness may be achieved throughout the lighting device 30.

The substrate 31 and the light cover 33 may be mounted on both opened surfaces of the light frame 32. The light frame 32 may include a first reflective portion 321 and a second reflective portion 322 that are spaced apart from each other, and a substrate mounting portion 324 connecting the first reflective portion 321 to the second reflective portion 322.

The first reflective portion 321 and the second reflective portion 322 may be disposed in the same longitudinal direction of the lighting device 30 and may define a portion of an outer surface of the lighting device 30. The first reflective portion 321 may be disposed adjacent to the rear surface of the panel assembly 21. At least a portion of the first reflective portion 321 may be in contact with the rear panel 212. In addition, a first reflective surface 321*a* may be disposed on an inner surface of the first reflective portion 321. The first reflective surface 321*a* may be disposed to be inclined so as to be closer to the rear panel 212 as the first reflective surface 321*a* extends in a direction away from the substrate 31.

The second reflective portion 322 may be spaced apart from the first reflective portion 321. In addition, the second reflective surface 322*a* may be disposed on an inner surface of the second reflective portion 322. The second reflective surface 322*a* may be formed to be inclined so as to be farther away from the rear panel 212 as the second reflective surface 322*a* extends in a direction away from the substrate 31. That is, the first reflective surface 321*a* and the second reflective surface 322*a* may be disposed to be further away from each other as the first reflective surface 321*a* and the second reflective surface 322*a* are closer to the substrate 31. In addition, an inclination of the second reflective surface 322*a* may be greater than that of the first reflective surface 321*a* with respect to the rear panel 212.

Thus, light emitted from the LED 311 may be reflected by the first reflective surface 321*a* and the second reflective surface 322*a* to effectively illuminate the space behind the door 20 and the door basket 24. Thus, the lighting device 30 may emit light in the form of surface light. For this, the light frame 32 may be made of a material that easily reflects light, and the first reflective surface 321*a* and the second reflective surface 322*a* may be coated for the reflection.

The substrate mounting portion 324 may connect the first reflective portion 321 to the second reflective portion 322 to provide a surface on which the substrate 31 is mounted. In addition, the substrate mounting portion 324 may include an LED hole 324*a* through which the LED is 311 exposed and an LED partition portion 324*b* that partitions the LEDs 311 from each other.

The LED hole 324*a* may be defined at a position corresponding to each of the plurality of LEDs 311, and each LED 311 may be disposed inside the LED hole 324*a*. In addition, the LED partition portion 324*b* may be disposed between the LEDs 311.

In addition, the substrate mounting portion 325 that supports both ends of the substrate 31 may be disposed on a rear end of the substrate mounting portion 324. The substrate mounting portion 325 may be disposed on a rear end of each of the first reflective portion 321 and the second reflective portion 322.

Thus, when the substrate 31 is seated on the substrate mounting portion 325, the substrate 31 may shield one opened surface of the light frame 32. In addition, the front surface of the substrate 31 may be in contact with the LED partition portion 324*b*, and the LED 311 may be disposed inside the LED hole 324*a*. In addition, the rear surface of the substrate 31 may be exposed to one surface of the light frame 32. In addition, a substrate connector 312 may protrude from the rear surface of the substrate 31. Thus, when the lighting device 30 is mounted, the connector 366 disposed inside the light case 25 and the substrate connector 312 may be coupled to each other.

In addition, a substrate restricting portion 328 may be further disposed on an end of the substrate mounting portion 324 to restrict the substrate. The substrate restricting portion 328 may be provided in plurality along the first reflective portion 321 and the second reflective portion 322 and may be provided in a hook shape to be hooked and restricted at the end of the substrate 31.

The light frame 32 may be provided in a pair like the substrate 31. That is, the light frame 32 may be constituted by an upper frame 32*a* on which the upper substrate 31*a* is mounted and a lower frame 32*b* on which the lower substrate 31*b* is mounted. The upper frame 32*a* and the lower frame 32*b* may have the same structure and shape.

When assembling the lighting device 30, the LED partition portions 326*a* and 326*b* that are in contact with each other may be disposed on the lower end of the upper frame 32*a* and the upper end of the upper frame 32*a*, respectively. In addition, a width of each of the LED partition portions 326*a* and 326*b* may be different from a width W1 of the other LED partition portion 326. The sum W2 of the widths of the LED partition portions 326*a* and 326*b* that are in contact with each other may be equal to the width W1 of the other LED partition portion 326.

The light cover 33 may be mounted on the other opened surface of the light frame 32 that faces one surface on which the substrate 31 is mounted. The light cover 33 may shield the opened surface of the light frame 32 and may be exposed through the light opening 222. The light cover 33 may be provided as a single configuration and may shield both the upper light frame and the lower light frame 32.

The light cover 33 may be made of a material that is capable of transmitting light emitted from the LED 311. In addition, a diffusion agent may be added, or the surface may be treated so that the lighting device 30 shines in the form of surface light.

The light cover 33 may include a cover front surface 331 that shields the opening of the light frame 32 and cover extension portions 332 and 333 extending from both ends of the cover front 331 in the vertical direction.

The cover front surface 331 may have a size corresponding to the light opening 222 or the accommodation space 250 of the light case 25. The cover front surface 331 may be provided in a planar shape and may define the same plane as an outer surface of the protrusion 221 of the door liner 22. That is, the cover front surface 331 may have the same inclination as the protrusion 221. In addition, a seating protrusion 331*a* that protrudes further downward than the cover extension portion 333 may be disposed on a lower end of the cover front surface 331, and the seating protrusion 331*a* may be seated on a front end of the light case 25 to support the light cover 33.

The cover extension portions 332 and 333 may include a first extension portion 332 and a second extension portion 333, which are disposed at both ends, respectively. The first extension portion 332 may be coupled to the first reflective portion 321, and the second extension portion 333 may be coupled to the second reflective portion 322. Stepped portions 323 and 334 are disposed on ends of the extension portions 332 and 333 and the reflection portions 321 and 322 so as to be coupled to each other.

In addition, a cover restrict portion 329 that restricts the light cover 33 may be further disposed on each of the ends of the first reflective portion 321 and the second reflective portion 322. The cover restrict portion 329 may be provided in plurality along the ends of the first reflective portion 321 and the second reflective portion 322 and may be provided in a hook shape to be hooked and restricted on an inner surface of each of the first extension portion 332 and the second extension portion 333.

The lighting device 30 may be mounted on the door 20 in an assembled module state. The lighting device 30 may be detachably mounted on the light case 25. Hereinafter, the structure of the light case 25 and the detachable structure of the lighting device 30 will be described in more detail with reference to the drawings.

Figure 9:
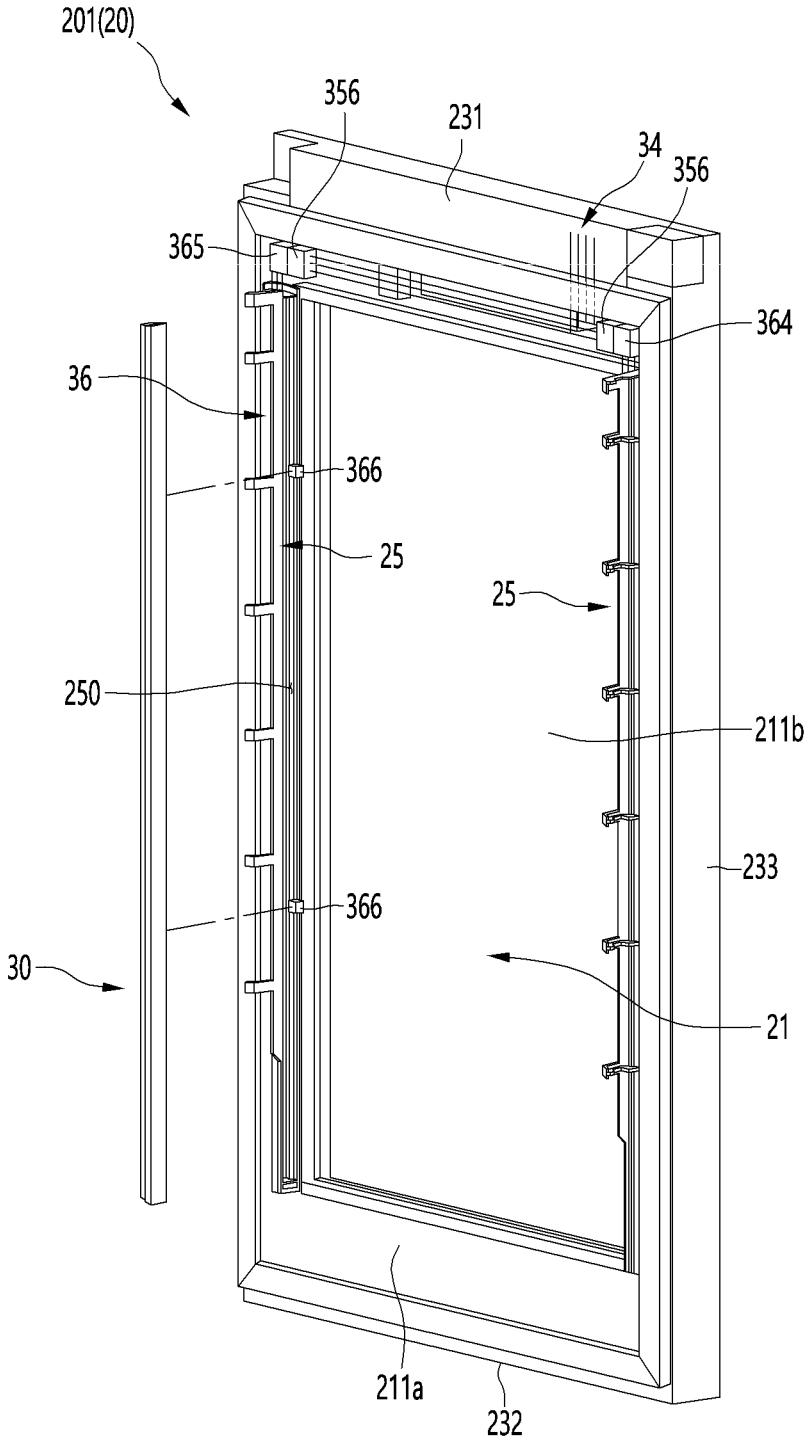
FIG. 9 is a perspective view illustrating a coupling structure of the lighting device that is in a state in which a door liner of the door is removed.
Figure 10:
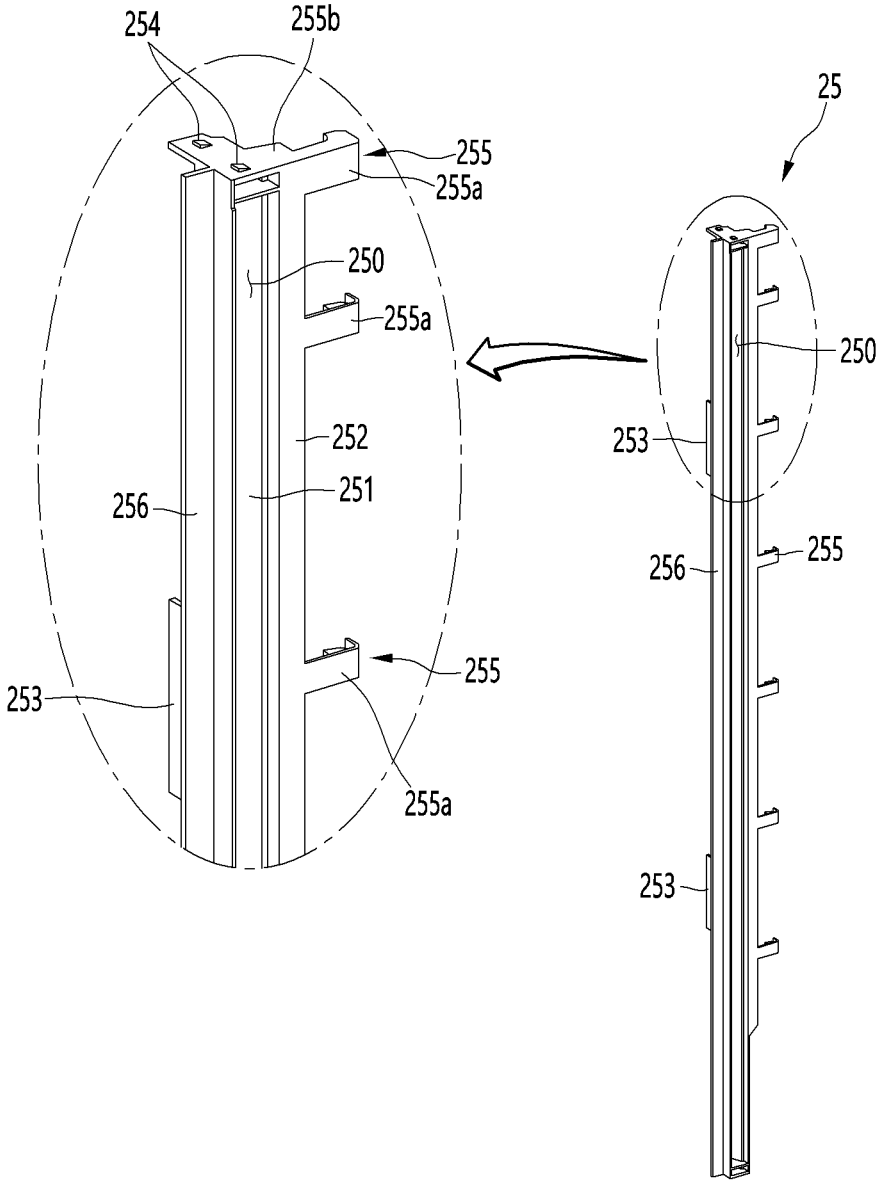
FIG. 10 is a perspective view of a light case when viewed in one direction according to an embodiment.
Figure 11:
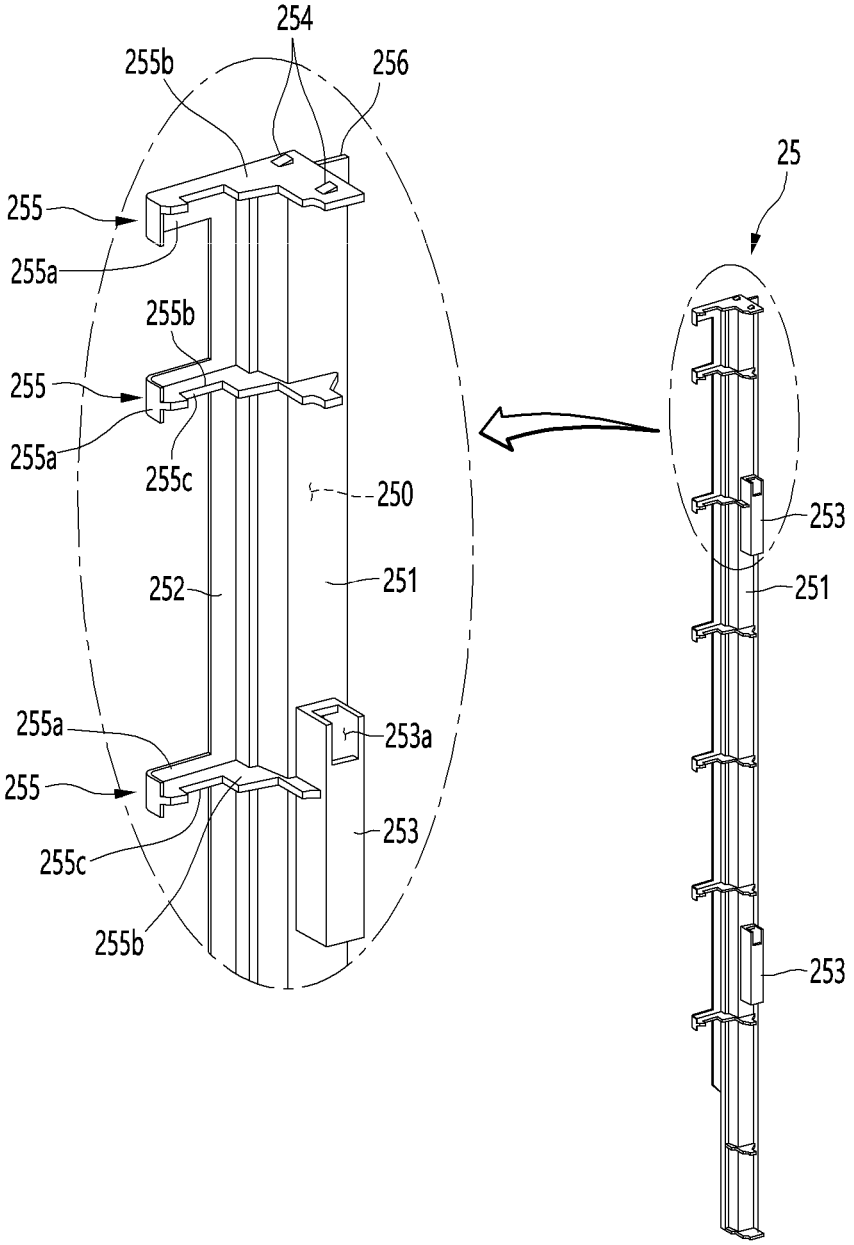
FIG. 11 is a perspective view of the light case when viewed in the other direction.

FIG. 9 is a perspective view illustrating a coupling structure of the lighting device that is in a state in which the door liner of the door is removed. In addition, FIG. 10 is a perspective view of the light case when viewed in one direction according to an embodiment. In addition, FIG. 11 is a perspective view of the light case when viewed in the other direction. In addition, FIG. 12 is a cross-sectional view taken along line 12-12 of FIG. 3.

As illustrated in the drawings, the light case 25 may be disposed within the protrusion 221. In addition, the light case 25 may be disposed on an area of a bezel portion 211*b* and thus may not be exposed to the outside. In addition, the light case 25 may define the accommodation space 250 in an inner space of the door liner 22 into which the insulating material 26 does not flow.

The light case 25 may be provided in a pair on both left and right sides with respect to the see-through portion 211*a*. In addition, the accommodation spaces 250 of the light cases 25 at both left and right sides may be opened in directions facing each other. The lighting device 30 may be mounted in the accommodation space 250, and the lighting device 30 may emit light toward the see-through portion 211*a*. Thus, a sufficient amount of light may be provided so that the entire area of the see-through portion 211*a* is brightened evenly. The light cases 25 at both the left and right sides may have the same structure and shape with only a difference in mounting position.

The light case 25 may be disposed to correspond to a vertical length of the see-through portion 211*a*. In addition, the accommodation space 250 may have a length corresponding to a vertical length of the lighting device 30 and may be shielded by the light cover 33.

The light case 25 may include an accommodation portion 251 defining the accommodation space 250, a first supporter 255 extending from one end of the accommodation portion 251 to support the door liner 22, and a second supporter 256 extending from the other end of the accommodation portion 251 to support the panel assembly 21.

Thus, in the state in which the light case 25 is mounted on the door 20, the light case 25 may provide the accommodation space 250 into which the insulating material does not flow. In addition, the light case 25 may prevent the insulating material from leaking by the first supporter 255 and the second supporter 256 and also maintain the arrangement position of the light case 25 even when the insulating material is charged, thereby securing the mounted position of the lighting device 30.

In detail, the accommodation portion 251 may extend to be elongated in the vertical direction and may be recessed to be opened toward the see-through portion 211*a*. An opening of the accommodation portion 251 may communicate with the liner opening 220. In addition, the accommodation portion 251 may be provided in a size that is enough to accommodate the lighting device 30. In addition, an entire body of the light case 25 may be provided by the accommodation portion 251.

One opened surface of the accommodation portion 251 may be provided to be stepped, and when the lighting device 30 is mounted, the light cover 33 may be seated so that the light cover 33 is maintained at an accurate mounting position.

In addition, a connecting portion 253 may be disposed on the recessed inner surface of the accommodation portion 251. The connecting portion 253 may be disposed at a position facing the substrate when the lighting device 30 is mounted and may be further recessed from the inner surface of the accommodation portion 251. In addition, the connecting portions 253 may be provided in a number corresponding to positions corresponding to the substrate connectors 312. A connector 366 connected to the substrate connector 312 and an electric wire connected to the connector 366 may be disposed inside the connecting portion 253. In addition, an opening 253*a* through which the electric wire enters and exits may be defined at one side of the connecting portion 253. The opening 253*a* may be sealed after the electric wire is disposed to prevent the insulating material 26 from inflowing.

Thus, when the lighting device 30 is installed, the connector 366 may be exposed to the connecting portion 253 in the state in which the door 20 is assembled, and the insulating material 26 is filled. Also, when the lighting device 30 is mounted, the connector 366 and the substrate connector 312 may be accommodated to be connected to each other inside the connecting portion 253.

The restricting protrusion 254 may be disposed on each of the top and bottom surfaces of the lighting device 30. The restricting protrusion 254 may be hooked and restricted on the inner surface of the accommodation portion 251 and may allow the lighting device 30 to be fixedly mounted within the light case 25.

A case front surface 252 extending outward may be disposed on one opened surface of the lighting device 30. The case front surface 252 may extend outward from the opened front surface of the accommodation portion 251. For example, the case front surface 252 may extend in a direction perpendicular to the opening direction of the accommodation portion 251. In addition, the case front surface 252 may be connected to the first supporter 255. In addition, the case front surface 252 may be in contact with the inner surface of the door liner 22.

The first supporter 255 may protrude from one side of the accommodation portion 251. The first supporter 255 may protrude from one side of the two sides of the accommodation portion 251 that is farthest from the panel assembly 21 and may extend to be disposed inside the protrusion 221. The first supporter 255 may support the inner surface of the door liner 22, particularly the inner surface of the protrusion 221 and thus may prevent the light case 25 from being separated from its position even when the foaming liquid for forming the insulating material 26 is filled.

The first supporter 255 may include a contact portion 255*a* and a partition portion 255*b*. The contact portion 255*a* may protrude in a direction crossing the extension direction of the accommodation portion 251. In addition, an outer surface of the contact portion 255*a* may be disposed to be in contact with the inner surface of the door liner 22. The contact portion 255*a* may be provided to have a predetermined width so as to be in surface contact with the inner surface of the door liner 22. In addition, the contact portion 255*a* may be bent along the inner shape of the protrusion 221 and may extend to the most protruding portion of the protrusion 221 to entirely support the protrusion 221, thereby more firmly fix the light case 25.

The partition portion 255*b* may be disposed to connect the outer surface of the accommodation portion 251 to the inner surface of the contact portion 255*a*. The partition portion 255*b* may extend perpendicular to the accommodation portion 251 and the contact portion 255*a* and be connected to the contact portion 255*a* and the accommodation portion 251 to provide the more firm first supporter 255.

The partition portion 255*b* may be disposed perpendicular to the front surface of the door 20 and may be provided to across-partition the inner space of the protrusion 221. In addition, an extending outer end of the partition portion 255*b* may be disposed to be in contact with the inner surface of the protrusion 221. That is, when the light case 25 is mounted, the first supporter 255 may entirely support the inner surface of the protrusion 221 at the same height by the contact portion 255*a* and the partition portion 255*b*.

The partition portion 255*b* may extend from the rear surface of the panel assembly 21, that is, up to the upper end of the protrusion 221 at the same height as the rear panel 212. The partition portion 255*b* may extend from the bottom surface of the protrusion 221 to the upper end of the protrusion 221. Thus, the partition portion 255*b* may have a stable support structure within the protrusion 221 and may be maintained at its mounting position within the door 20 even when the insulating material 26 is injected.

A partition portion groove 255*c* may be defined in an end of the partition portion 255*b*. An opened space may be defined between an end of the partition portion 255*b* and the door liner 22 by the partition portion groove 255*c*, and thus, when the foaming liquid for molding the insulating material 26 is injected, the foaming liquid may flow to pass through the partition portion groove 255*c*, and then, the foaming liquid may pass through the first supporter 255 to evenly form the insulating material 26 throughout the entire inside of the protrusion 221.

The first supporter 255 may be provided in plurality in the vertical direction along the light case 25. Here, the first supporters 255 may have the same structure and shape. Thus, the plurality of partition portion grooves 255*c* may be disposed on the same extension line, and the foaming liquid may flow smoothly while sequentially passing through the plurality of first supporters 255.

The second supporter 256 may protrude from the lower end of the accommodation portion 251. The second supporter 256 may protrude in a direction opposite to the protruding direction of the first supporter 255. The second supporter 256 may be supported on the panel assembly 21.

The second supporter 256 may protrude from one side that is away from the opened front end of the accommodation portion 251. In addition, the second supporter 256 may protrude further forward than the rear surface of the panel assembly 21, i.e., the rear panel 212.

In addition, the second supporter 256 may continuously extend from the upper end to the lower end of the accommodation portion 251. In addition, one end of the lighting device 30 may be entirely supported by the panel assembly 21.

In detail, the second supporter 256 may be restricted to be in contact with an edge of the rear surface and a perimeter of the panel assembly 21. That is, the outer surface of the accommodation portion 251 may be in contact with the rear panel 212, and the second supporter 256 may be in contact with the perimeter of the panel assembly 21. Thus, the light case 25 may be seated on an edge of a lateral end of the rear surface of the panel assembly 21.

A sealant 215 may be applied to the perimeter of the panel assembly 21. The sealant 215 may be applied around the assembled panel assembly 21 to seal a gap between the spacer 214 and the front panel 211 and a gap between the rear panel 212 and intermediate panel 213. The sealant 214 may define the perimeter of the panel assembly 21, and thus, when the light case 25 is mounted, the second supporter 256 may be fixed to be in contact with the sealant 215.

Of course, the sealant 214 may be omitted in the panel assembly 21 when the sealing between the spacer 214 and the front panel 211 and between the rear panel 213 and intermediate panel 212 is secured. When the sealant 214 is omitted, the second supporter 256 may be fixed to be in contact with ends of the rear panel 212 and the spacer 214 when the light case 25 is mounted.

The light case 25 may be firmly fixed in its position inside the door 20 by the first supporter 255 and the second supporter 256, and even if the insulating material is injected into the protrusion 221, the light case 25 may be maintained in position. In addition, when the lighting device 30 is mounted on the light case after injecting the insulating material 26, the lighting device 30 may be always maintained in correct mounting position. Thus, the lighting device 30 may always emit light toward the see-through portion 211*a* at the accurate position.

A wire connection state of the lighting device 30 at both sides will be described with reference to the drawings.

Figure 13:
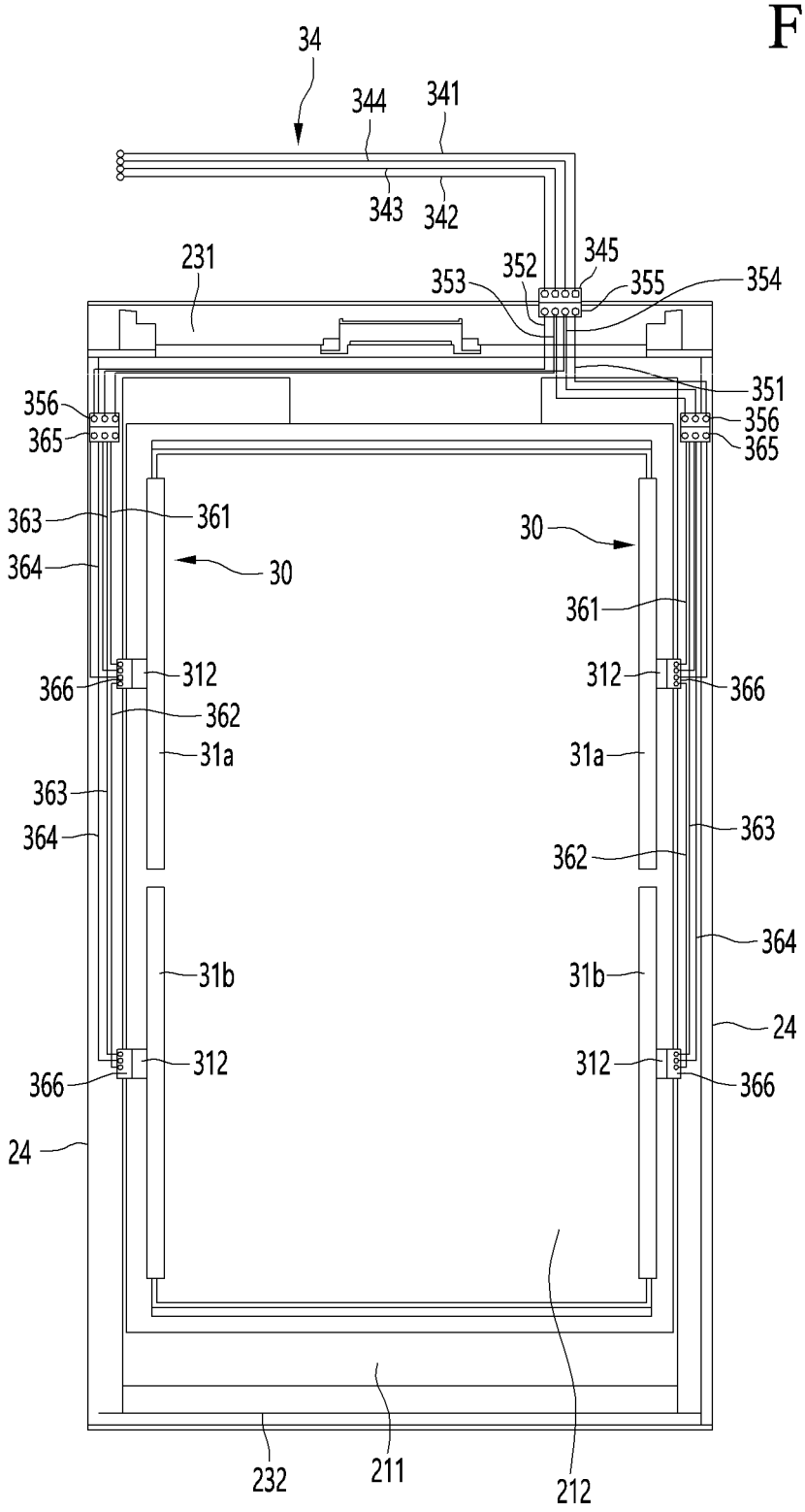
FIG. 13 is a view illustrating an electric wire connection structure of the lighting device in the door.

FIG. 13 is a view illustrating an electric wire connection structure of the lighting device in the door.

As illustrated in the drawing, the lighting device 30 may be provided at each of both left and right sides of the see-through portion 211*a*. In addition, each of the lighting devices 30 may include an upper substrate 31*a* and a lower substrate 31*b*.

The upper substrate 31*a* and the lower substrate 31*b* may have a structure in which each of the substrate connectors 312 is connected to the connector 366, and the electric wire connected to the connector 366 may be guided to the outside of the door 20 through the connection connectors 356 and 365 and the main connectors 345 and 355.

In detail, the electric wire 34 guided to the door 20 may be constituted by a first signal line 341, a second signal line 342, a power line 343, and a ground line 344. The electric wire 34 may pass through the door 20 in a minimal number and be connected to a controller of the cabinet 10. For example, the electric wire 34 may be provided as four strands.

The first signal line 351 and the second signal line 352 connected to the main connector 355 may be guided to respective connection connectors 356 and 365 provided at both the left and right sides, respectively. In addition, each of the power line 353 and the ground line 354 connected to the main connector 355 may be branched into two lines and then be guided to the connection connectors 356 and 365 at both the left and right sides. Thus, the lighting device 30 disposed at each of both the left and right sides may be independently controlled by the respective connection connectors 356 and 365.

In addition, the power line 363 and the ground line 364 may be branched from each of the connection connectors 365 and then be connected to the substrate connectors 312 of the upper substrate 31*a* and the lower substrate 31*b* of the connector 366. In addition, the main signal line 361 of each of the connection connectors 356 and 365 may be connected to the substrate connector 312 of the upper substrate 31*a* through the connector 366.

Here, the upper substrate 31*a* and the lower substrate 31*b* may be connected to each other by a sub signal line 362. Thus, a control signal transmitted to the upper substrate 31*a* through the main signal line 361 may be transmitted to the lower substrate 31*b* through the sub signal line 362. That is, the upper substrate 31*a* and the lower substrate 31*b* may be connected in series by the sub signal line 362. In addition, the upper substrate 31*a* and the lower substrate 31*b* may be controlled by one main signal line 361 that leads into the lighting device 30. The upper substrate 31*a* and the lower substrate 31*b* may operate at the same time and controlled to emit light having the same color. Of course, if necessary, the upper substrate 31*a* and lower substrate 31*b* may be controlled to operate independently and emit light having different colors. In addition, if necessary, the lighting devices 30 at both the left and right sides may be controlled independently.

Hereinafter, the operation of the refrigerator 1 having the above structure will be examined with reference to the drawings.

Figure 14:
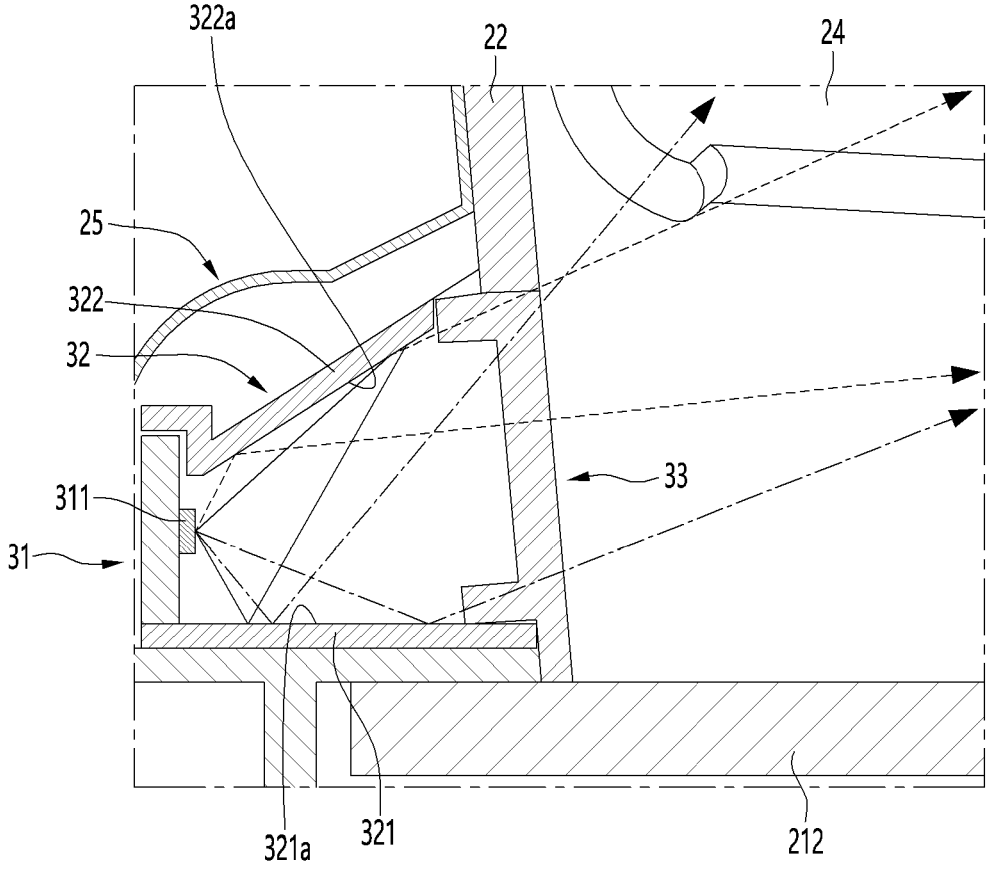
FIG. 14 is a view illustrating a light emission state of the lighting device.

FIG. 14 is a view illustrating a light emission state of the lighting device. In addition, FIG. 15 is a front view illustrating the refrigerator in a state in which the lighting device is turned on.

In the refrigerator 1, when the lighting device 30 is turned off, as illustrated in FIG. 1, the see-through portion 211*a* may become opaque so that the space behind the door 20 is not visible.

Figure 15:
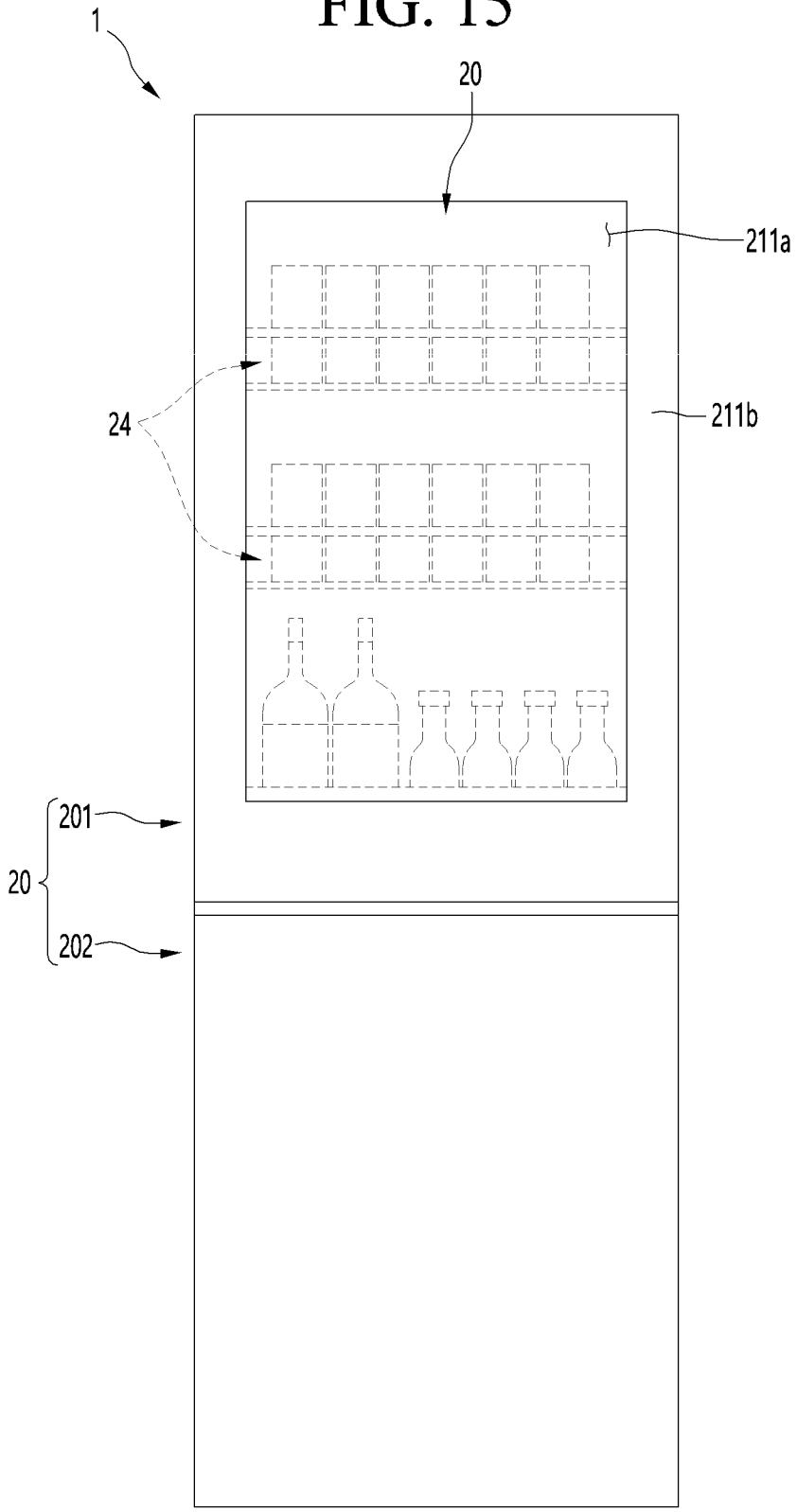

In addition, when the lighting device 30 is turned on, the space behind the door may be brightened as illustrated in FIG. 15, and the see-through portion 211*a* may become transparent so that the space behind the door is seen.

The lighting device 30 may emit light in opposite directions from both sides of the see-through portion 211*a* to emit the light from a position that is in contact with the rear panel 212, thereby brightening the rear side of the door that is close to the panel assembly 21. In particular, the lighting device 30 may emit the light between the rear panel 212 and the door basket 24 so that the emitted light is reflected and scattered by the rear panel 212 and the door basket 24. As a result, the entire surface of the see-through portion 211*a* may be seen as evenly bright. In addition, when light having a specific color is emitted from the LED 311, the entire see-through portion 211*a* may be seen to be bright with an even and uniform color.

In detail, as illustrated in FIG. 14, the light emitted from the LED 311 may be reflected by the first reflective surface 321*a* and the second reflective surface 322*a* to passes through the light cover 33.

Here, at least some of the light reflected from the first reflective surface 321*a* may be directed to the door basket 24. In addition, the first reflective surface 321*a* may be disposed parallel to the rear panel 212. In addition, the first reflective surface 321*a* may be provided to be less than an inclination of the second reflective surface 322*a*. Thus, the light emitted from the LED 311 may be effectively directed to the door basket 24.

In addition, the second reflective surface 322*a* may have an inclination greater than that of the first reflective surface 321*a*. Thus, the light emitted from the LED 311 may be reflected by the second reflective surface 322*a* and then emitted toward the door basket 24 to overlap the irradiated area by the first reflective surface 321*a*. In addition, some of the light emitted to the door basket 24 may be reflected or scattered and then directed to the rear panel 212 to brighten the entire space behind the door. Therefore, visualization may be achieved through the see-through portion 211*a*, and the overall bright and uniform color may be secured. In addition, the space that is seen through the see-through portion 211*a* may be brightened by indirect lighting.

In addition to the foregoing embodiment, various embodiments may be exemplified. In another embodiment of the present disclosure, only a structure of the door on which a lighting device is mounted is different, and structures of the lighting device and the light case may be the same. Thus, the same components as the above-described embodiments are denoted by the same reference numerals, and detailed descriptions and illustrations thereof may be omitted.

Hereinafter, another embodiment will be in more detail with reference to the drawings.

Figure 16:
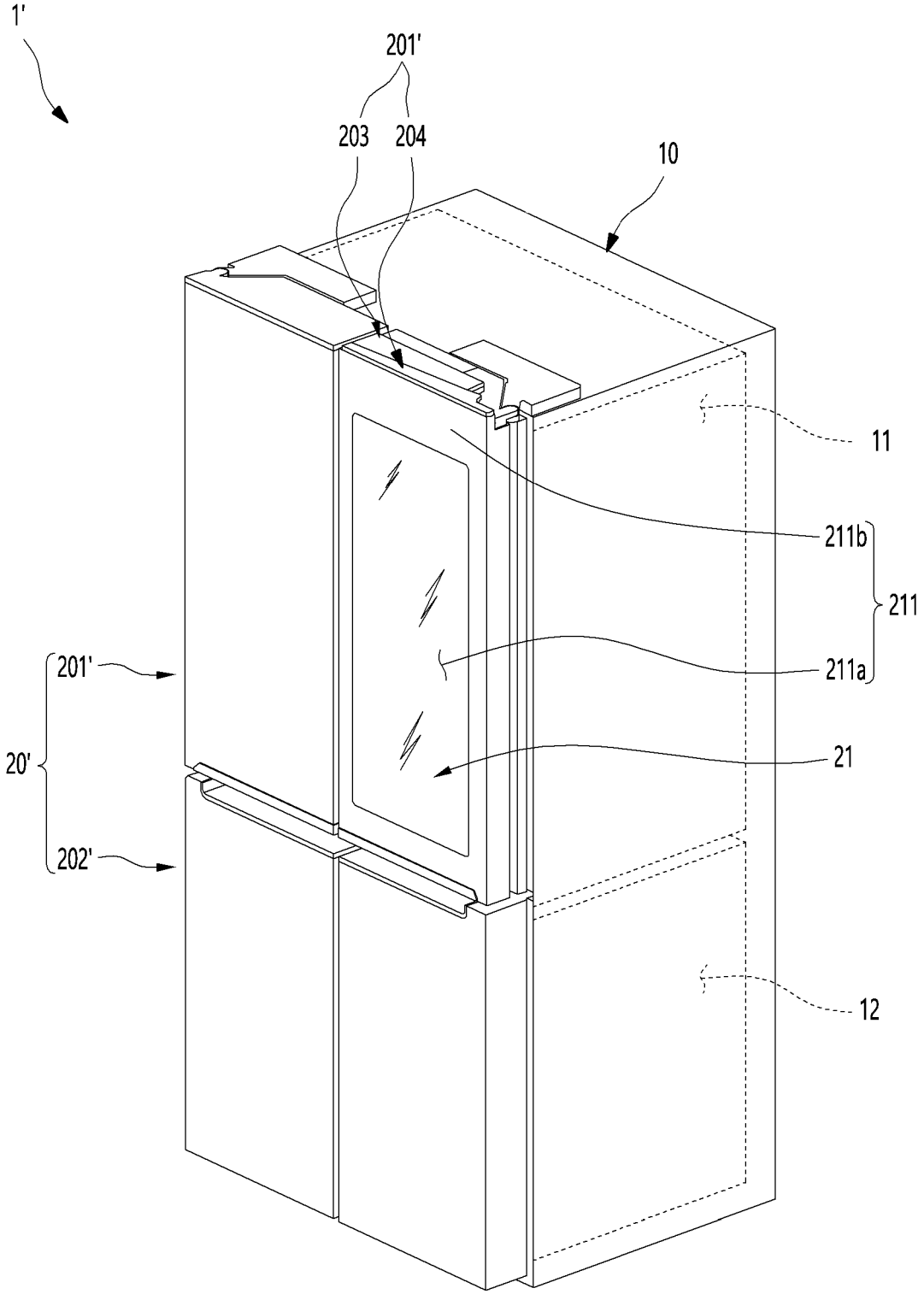
FIG. 16 is a perspective view of a refrigerator according to another embodiment.
Figure 17:
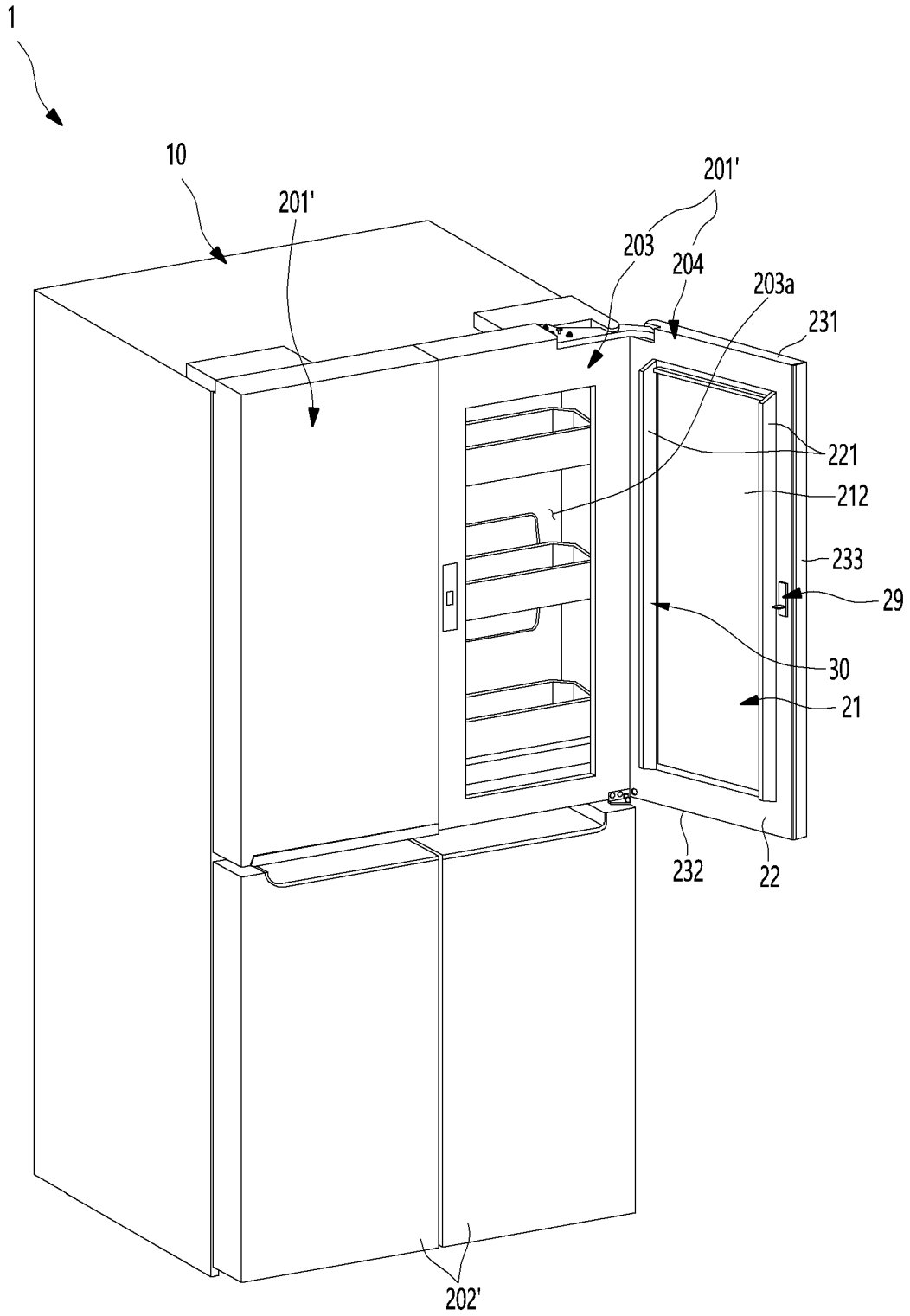
FIG. 17 is a perspective view illustrating a state in which a door of the refrigerator is opened.

FIG. 16 is a perspective view of a refrigerator according to another embodiment. In addition, FIG. 17 is a perspective view illustrating a state in which a door of the refrigerator is opened.

As illustrated in the drawings, a refrigerator 1' according to another embodiment may include a cabinet 10 defining a storage space and a door 20' that opens and closes the storage space.

The storage space of the cabinet 10 may be divided into upper and lower sections. Here, a first storage space 11 may be defined at an upper portion, and a second storage space 12 may be defined at a lower portion. In addition, the door 20' may include a first door 201' that opens and closes the first storage space 11 and a second door 202' that opens and closes the second storage space 12.

The first door 201' and the second door 202' may be rotatably mounted on the cabinet 10. In addition, each of the first door 201' and the second door 202' may be provided as a pair at both left and right sides and may be configured to rotate independently.

The first door 201' may be configured in the form of a double door in which a pair of doors 203 and 204 are arranged in a front and rear direction. As an example, the first door 201' may include a main door 203 and a sub door 204.

The main door 203 may be connected to the cabinet by a hinge to open and close the first storage space 11. In addition, an opening 203*a* may be defined in the main door 203, and food may be stored in the door storage space behind the sub door 204 through the opening 203*a*. In addition, it will also be possible to store food in the storage space within the cabinet 10 through the opening 203*a*.

The sub door 204 may be provided in front of the main door 203. The sub door 204 may be rotatably connected to the main door 203. The sub door 204 may rotate in the same direction as the main door 203 to open and close the opening 203*a* by the rotation.

The sub door 204 may be provided with a panel assembly 21 in which a see-through portion 211*a* is defined. The panel assembly 21 may be made of a transparent material. In addition, the panel assembly 21 may define at least a portion of the front surface of the sub door 204. Thus, when the sub door 204 is closed, the door storage space inside the opening 203*a* or the storage space of the cabinet 10 may be seen.

The panel assembly 21 may include a front panel 211 made of a transparent material and a rear panel 212, and the front panel 211 and the rear panel 212 may be spaced apart from each other to define an insulating space.

The front panel 211 may define at least a portion of a front surface of the sub door 204. In addition, a see-through portion 211*a* may be provided at a center of the front panel 211, and an opaque bezel portion 211*b* may be disposed outside the see-through portion 211*a*, that is, around the front panel 211.

The sub door 204 may further include a door liner 22 defining a rear surface. In addition, a liner opening 220 that is shielded by the rear panel 212 may be defined in the door liner 22.

The sub door 204 may further include an upper cap decoration 231 and a lower cap decoration 232, which define top and bottom surfaces, and a side frame 233 that defines a side surface. In addition, a foaming liquid may be injected into a space defined by combination of the panel assembly 21, the door liner 22, the upper cap decoration 231, the lower cap decoration 232, and the side frame 233 so that an insulating material is filled.

A protrusion 221 protruding backward may be disposed on at least one side of a perimeter the liner opening 220. As an example, the protrusion 221 may be disposed along both left and right ends of the liner opening 220. The protrusion 221 may be inserted into the opening 203*a* when the sub door 204 is closed to prevent cold air from leaking from a door storage space.

The lighting device 30 and a light case 25 on which the lighting device 30 is mounted may be disposed inside the protrusion 221. Thus, a rear space of a see-through portion 211*a* may be brightened depending on on/off of the lighting device 30, and a color of the see-through portion 211*a* may be changed depending on a color of the lighting device 30. In addition, the light case 25 may define a space inside the sub door 204 including the protrusion 221, into which the insulating material does not flow. Thus, the light case 25 may be maintained in a correct mounting position even when the foaming liquid for molding the insulating material is injected. The detailed structure of the lighting device 30 and the light case 25 may be the same as the above-described embodiment.

The door liner 22 may be provided with a gasket along a perimeter of the liner opening 220. In addition, the sub door 204 may be equipped with an opening/closing device 29 for opening and closing the sub door 204.

Figure 18:
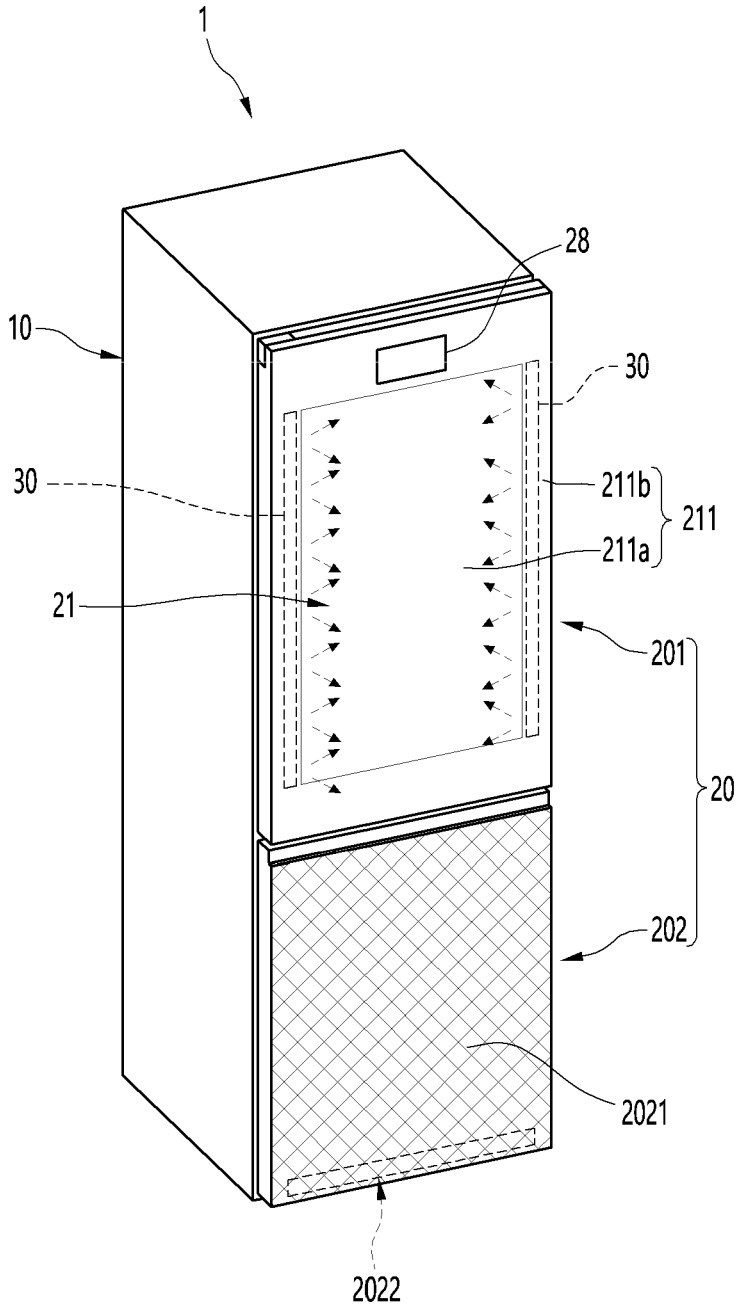
FIG. 18 is a perspective view of a refrigerator according to further another embodiment.

FIG. 18 is a perspective view of a refrigerator according to further another embodiment of the present disclosure.

An overall structure and shape of a refrigerator according to further another embodiment of the present disclosure are the same as those of the above-described embodiment except for some differences only in the structure of a second door and a display and an operation of a lighting device. Thus, the detailed description of the same configuration as the above-described embodiment will be omitted, and only the differences will be described in detail.

As illustrated in the drawing, a refrigerator 1 according to further another embodiment may include a cabinet 10 in which a storage space is defined, and doors 20' and 30' that open and close the storage space.

The cabinet 10 may be divided into upper and lower storage spaces, and the upper and lower storage spaces may be opened and closed by doors 20, respectively. Of course, a shape and arrangement of the storage space and the doors 20 may vary depending on the type of refrigerator.

The doors 20 may include a first door 201 that opens and closes the upper storage space and a second door 202 that opens and closes the lower storage space. The second door 202 may be provided below the first door 201. In addition, the first door 202 and the second door 201 may be rotatably mounted on the cabinet.

The first door 201 may include a panel assembly 21 through which the storage space is capable of being seen. The panel assembly 21 may be selectively seen by turning the lighting device 30 on and off. A structure of the first door 201 including the panel assembly 21 and the lighting device 30 may be the same as the above-described embodiment.

A front surface of the first door may be defined by a front panel 211 of the panel assembly 21. In addition, an opaque bezel portion 211*b* may be disposed around the front panel 211, and a see-through portion 211*a* may be disposed inside the bezel portion 211*b*.

The see-through portion 211*a* may be selectively transparent so that food stored in the storage space or the door basket 24 is identified. The lighting device 30 may be provided at each of both left and right sides of the see-through portion 211*a*. The lighting device 30 may extend vertically along each of both left and right ends of the see-through portion 211*a*. In addition, the lighting devices 30 at both the left and right sides may emit light in directions facing each other, and when the lighting devices 30 are turned on, a rear side of the see-through portion 211*a* may be brightened to allow a user to see the rear side of the see-through portion 211*a*.

In addition, the lighting device 30 may include an RGB LED that emits light to shine in various colors. Thus, the see-through portion 211*a* may shine in various colors.

A display 28 may be provided on an upper portion of the first door 201. An operation status of the refrigerator 1 or various information may be displayed. The display 28 may be disposed outside the see-through portion 211*a* and within an area of bezel portion 211*b*. In addition, the display 28 may be configured as a touch display 28 so that the user sets and operates the operation of the refrigerator 1.

A color of light emitted from the lighting device 30 may be manipulated by the display 28. For example, the user may set an operation of the lighting device 30 by manipulating the display 28 so that the see-through portion 211*a* is displayed in a set color.

As another example, the color of the light emitted from the lighting device 30 may be determined in conjunction with information displayed on the display 28. Thus, the color of the light emitted from the lighting device 30 may correspond to the color or information output from the display 28. In addition, the color of the light emitted from the lighting device 30 may be determined depending on the operation status of the refrigerator 1. In addition, if a separate sensing device is provided, the lighting device 30 may be set to operate by detecting user's proximity, and the see-through portion 211*a* may be set to shine in different colors depending on the user's proximity.

The second door 202 may be provided to have various colors. The lighting device 30 may determine the color of the light emitted depending on the color of the second door 202. That is, the color that is seen through the see-through portion 211*a* of the first door 201 may be the same as the color of the second door 202, or may be set to a corresponding color such as a similar series or complementary color.

In addition, the second door 202 may be configured to shine in various colors. A front surface of the second door 202 may be provided as a panel 2021 through which light is transmitted. The panel 2021 may be made of a material capable of transmitting light, such as glass or plastic.

In addition, a door lighting device 2022 may be further installed inside the second door 202 to illuminate the panel 2021. The door lighting device 2022 may include an RGB LED. Thus, the color of the panel 2021 may be determined according to the color of the light emitted from the door lighting device 2022, and the color of the outer appearance of the second door 202 may be determined.

In addition, the lighting device 30 may operate in conjunction with the operation of the door lighting device 2022. For example, the color of the see-through portion 211*a* may be changed in conjunction with the color of the outer appearance of the second door 202. That is, the lighting device 30 may be set to emit light having a color corresponding to the color of the light emitted from the door lighting device 2022, such as the same or similar color or a complementary color.

In addition, one of the see-through portion 211*a* and the pair of lighting devices 30 disposed at both the left and right sides may operate in conjunction with the operation of the door lighting device 2022.

In addition, the user may set the operation of the lighting device 30 and the door lighting device 2022 through the manipulation of the display 28. Of course, if the refrigerator 1 is communicatively connected to a cell phone or another home appliance, it will also be possible to set the operation of the lighting device 30 and the door lighting device 2022 using the cell phone or another home appliance.

The following effects may be expected in the refrigerator according to the proposed embodiments of the present invention.

In the refrigerator according to the embodiments, the lighting device may be easily detachably mounted on the light case in the state of being assembled by injecting the insulating material into the door. Therefore, there may be the advantage in that the damage of the lighting device is prevented when molding the insulating material, and the maintenance of the lighting device is easy.

Particularly, the connector may be provided in the light case, and the structure capable of being connected to the substrate connector of the lighting device may be provided to more easily mount and separate the lighting device.

The light case may be provided inside the protrusion protruding from the door liner to prevent the insulating material filled into the protrusion from leaking. Therefore, the light device may be mounted inside the protrusion filled with the insulating material, and the insulation performance of the door may be secured by the insulating material inside the protrusion.

The light case may connect the door liner to the panel assembly through the first supporter and the second supporter and thus may be more firmly fixed inside the door liner. In addition, even when the foaming liquid for molding the insulating material is injected, the leakage of the insulating material may be prevented, and the mounted position of the light case may be maintained. Therefore, the mounting of the lighting device at the fixed position may be secured, and the gap may be prevented from occurring between the door liner and the panel assembly to improve the outer appearance.

In addition, the first supporter may be provided in plurality and have the structure that extends along the light case so as to be stably mounted inside the protrusion. In addition, the first supporter may be constituted by the contact portion that is in contact with the door liner and the partition portion that connects the contact portion to the accommodation portion of the liner case to provide the more stable mounting structure inside the protrusion. In addition, the groove may be defined in the partition portion provided on the first supporter, and even when the plurality of first supports are provided, the foaming liquid for the molding of the insulating material may smoothly flow.

The lighting device may be provided to correspond to the length of the viewing window and may be disposed at each of both left and right sides of the viewing window that is elongated in the vertical direction to more effectively illuminate the rear side of the see-through portion, and thus, the color of the see-through portion may be seen uniformly.

Particularly, the lighting device, which is disposed to be elongated vertically, may have the structure in which the plurality of substrates are connected in series to prevent the molding defects of the substrates and maintain the quality. In addition, there may be the advantage in that the plurality of substrates are controlled through the minimum number of signal lines.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage space; and a door configured to open and close the storage space, wherein the door comprises:

a panel assembly comprising (i) a front panel that defines a front surface of the door and is made of a transparent material, and (ii) a rear panel disposed rearward relative to the front panel and made of a transparent material, a door liner that defines a rear surface of the door, the door liner having a liner opening that is covered by the rear panel, an insulating material provided in a space between a perimeter of the panel assembly and the door liner, a lighting device configured to illuminate a space defined rearward relative to the door, the lighting device comprising (i) a substrate, (ii) a plurality of light emitting diodes (LEDs) disposed at the substrate, and (iii) a substrate connector disposed at the substrate, a light case that is coupled to the door liner and defines a recess space accommodating the lighting device, the light case connecting the rear panel to the door liner and being configured to block the insulating material from entering the light case, and a connector disposed inside the light case and configured to couple to the substrate connector, wherein the lighting device is configured to be detachably mounted inside the light case based on coupling the substrate connector to the connector in the light case, and wherein the light case further defines an opening that is provided between the rear panel and the door liner and configured to expose the recess space and to provide access to the lighting device in the recess space.

2. The refrigerator according to claim 1, wherein the door further comprises a protrusion that is disposed at the door liner and protrudes rearward relative to the rear panel, and wherein the insulating material is provided in the protrusion, and the light case is disposed inside the protrusion.

3. The refrigerator according to claim 2, wherein the front panel comprises:

a see-through portion that allows a rear space of the door to be visible from an outside of the door; and a bezel portion disposed around the see-through portion, and wherein the light case is disposed at the bezel portion.

4. The refrigerator according to claim 3, wherein the protrusion is one of protrusions that are disposed at sides of the see-through portion, and wherein the lighting device is one of lighting devices that are disposed at the protrusions, respectively, the lighting devices being configured to emit light toward each other.

5. The refrigerator according to claim 3, wherein the protrusion is disposed along at least one side of the see-through portion.

6. The refrigerator according to claim 2, wherein the protrusion is one of a pair of protrusions that are spaced apart from each other and have inner surfaces facing each other, the pair of protrusions extending vertically along the door liner, wherein the light case is one of a pair of light cases that are accommodated in the pair of protrusions, respectively, wherein each of the pair of protrusions defines:

a basket mounting portion configured to support a door basket, and a light opening that accommodates one of the pair of light cases, and wherein the basket mounting portion and the lighting opening are defined at the inner surfaces of the pair of protrusions.

7. The refrigerator according to claim 6, wherein the light opening is a cut portion at an end of the door liner facing a rear surface of the rear panel, the light opening extending vertically along each of the pair of protrusions.

8. The refrigerator according to claim 6, wherein the lighting device is disposed between the basket mounting portion and the rear panel.

9. The refrigerator according to claim 8, wherein the door basket is one of a plurality of door baskets that are spaced apart from one another in a vertical direction, and wherein the lighting device extends through the plurality of door baskets in the vertical direction.

10. The refrigerator according to claim 2, wherein the light case comprises:

an accommodation portion that defines the recess space and is exposed through the door liner, the accommodation portion being recessed from the light case and accommodating the lighting device;

a plurality of first supporters that are arranged along the accommodation portion and protrude from the light case in a first direction, the plurality of first supporters being configured to support an inner surface of the protrusion; and a second supporter that extends along the accommodation portion and protrudes in a second direction opposite to the first direction, the second supporter being in contact with the panel assembly.

11. The refrigerator according to claim 10, wherein the light case further comprises a connecting portion that is disposed at the accommodation portion, wherein the connector in the light case is disposed at the connecting portion and connected to the lighting device through an electric wire, at least a portion of the electric wire being disposed at the connecting portion, and wherein the lighting device is connected to the connector at a position inside the accommodation portion.

12. The refrigerator according to claim 10, wherein each of the plurality of first supporters comprises:

a contact portion that is in contact with the inner surface of the protrusion and extends to an end of the protrusion; and a partition portion that extends from the accommodation portion and the contact portion and partitions an inside of the protrusion.

13. The refrigerator according to claim 12, wherein the plurality of first supporters define a plurality of partition portion grooves, respectively, the partition portion of each of the plurality of first supporters defining one of the plurality of partition portion grooves, and wherein the insulating material is provided into the protrusion through the plurality of partition portion grooves.

14. The refrigerator according to claim 10, wherein a front surface of the accommodation portion supports a rear surface of the panel assembly, and wherein the second supporter supports the perimeter of the panel assembly.

15. The refrigerator according to claim 1, wherein the lighting device further comprises:

a light frame that supports the substrate and defines a first open surface; and a light cover that covers the first open surface of the light frame and is configured to transmit light emitted from the LEDs, and wherein the light cover further covers the recess space of the light case.

16. The refrigerator according to claim 15, wherein the LEDs comprise red-green-blue (RGB) LEDs and are configured to emit light having one or more colors selected by a user.

17. The refrigerator according to claim 15, wherein the light frame comprises:

a first reflective surface and a second reflective surface that are spaced apart from each other and faces each other; and a substrate supporter that connects the first reflective surface to the second reflective surface and supports the substrate, and wherein the light frame further defines a second open surface that is covered by the substrate.

18. The refrigerator according to claim 17, wherein the first reflective surface is disposed adjacent to the panel assembly, wherein the second reflective surface is disposed farther from the panel assembly than the first reflective surface, and wherein an inclination of the second reflective surface relative to the rear panel is greater than an inclination of the first reflective surface relative to the rear panel.

19. The refrigerator according to claim 15, wherein the substrate is one of a plurality of substrates that are connected electrically in series, and wherein the refrigerator further comprises:

a main signal line connected to one of the plurality of substrates, and a sub signal line that connects the plurality of substrates to one another.

20. The refrigerator according to claim 15, wherein the lighting device is detachably mounted to the light case through the liner opening of the door liner and the opening of the light case, and wherein the substrate connector is disposed at a rear surface of the substrate.

* * * * *